US009205947B1

(12) United States Patent
Waldschmidt et al.

(10) Patent No.: US 9,205,947 B1
(45) Date of Patent: Dec. 8, 2015

(54) MULTI-COMPONENT CONTAINER WITH AIR CELL END PANEL REINFORCEMENTS

(75) Inventors: David D. Waldschmidt, De Pere, WI (US); Lyle A. Thomas, Seymour, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 298 days.

(21) Appl. No.: 13/483,432

(22) Filed: May 30, 2012

(51) Int. Cl.
*B65D 3/22* (2006.01)
*B65D 5/32* (2006.01)

(52) U.S. Cl.
CPC ..... *B65D 5/32* (2013.01)

(58) Field of Classification Search
CPC ..... B65D 5/32
USPC ..... 229/122.32, 241, 200, 243, 204, 235, 229/166, 122.21, 122.24; 206/750, 763; 220/627, 670
See application file for complete search history.

(56) References Cited

U.S. PATENT DOCUMENTS

| | | | | |
|---|---|---|---|---|
| 3,700,159 | A | 10/1972 | Beigel | |
| 3,744,702 | A * | 7/1973 | Ellison | 229/122.32 |
| 4,944,394 | A | 7/1990 | Campbell | |
| 5,277,360 | A | 1/1994 | DeMott | |
| 5,826,728 | A | 10/1998 | Sheffer | |
| 5,839,650 | A | 11/1998 | Sheffer | |
| 5,950,914 | A * | 9/1999 | Dunton et al. | 229/122 |
| 6,015,084 | A * | 1/2000 | Mathieu et al. | 229/122.32 |
| 6,045,038 | A | 4/2000 | Smith et al. | |
| 6,116,498 | A | 9/2000 | Sheffer | |
| 6,915,947 | B2 | 7/2005 | Siurek et al. | |
| 7,210,614 | B2 | 5/2007 | Mazurek | |
| 7,472,819 | B1 | 1/2009 | Wachter | |
| 7,581,672 | B1 | 9/2009 | Keefe | |
| 7,798,391 | B2 * | 9/2010 | Tibbels et al. | 229/125.19 |
| 2003/0141356 | A1 | 7/2003 | Sheffer | |
| 2008/0000955 | A1 | 1/2008 | Phan | |
| 2010/0314436 | A1 | 12/2010 | Tao | |

* cited by examiner

*Primary Examiner* — Christopher Demeree
(74) *Attorney, Agent, or Firm* — Boyle Fredrickson, S.C.

(57) ABSTRACT

A stackable container for displaying a product and a method of use, the container having: a primary blank configured to form an exterior of the container and first and second secondary blanks configured to form a first and second interior side wall of the container respectively. In a first configuration, the first and second secondary blanks are pivotably affixed to the primary blank in a substantially coplanar orientation. In a second configuration, the first and second secondary blanks are folded to form a container having a bottom wall, a front wall, a rear wall, a first exterior side wall, and a second exterior side wall. The first and second secondary blanks form first and second interior side walls offset from the first and second exterior side walls respectively, such that a void is provided between the interior side wall and the exterior side wall.

20 Claims, 19 Drawing Sheets

MULTI-COMPONENT CONTAINER WITH AIR CELL END PANEL REINFORCEMENTS

BACKGROUND OF THE INVENTION

The present invention relates generally to a container and, more particularly a stackable multiple-piece shipping and display container.

Multipurpose packaging is often used in the shipping and distribution of consumer goods and products. Secure packaging ensures the efficient, economical, and safe delivery of products through various distribution channels. However, once the packaged product arrives at a destination, it is often desirable to use the shipping container as a display container. This transition reduces the need for permanent display containers at the retail location. For example, in the delivery of foodstuffs to a grocery store, the transformation of the shipping container into a display container reduces time and effort that would otherwise be spent shelving the product.

However, it is often desirable to display multiple containers of packaged products, such as in large specialty displays, or for products that sell rapidly and would otherwise require repeated restocking. For example many retail stores often assemble displays of specialty products in large quantities to draw the attention of consumers. As such, it often becomes necessary to stack multiple packaging containers on top of one another to form these large displays. While stacking traditional sealed six-sided containers is relatively uncomplicated, this process becomes challenging when one is attempting to stack packages that have been transformed into display containers. That is to say, display containers such as trays, which lack either front panels, top panels or both front and top panels are ideal for allowing consumers easy access to the products contained therein. However these containers often lack significant structural integrity as the front and/or top walls have been removed. Accordingly, the vertical stacking of such display containers can result in the display containers leaning, falling or crushing one another, as well as the products contained therein.

Stacking is also a common form of display in big box stores or warehouse stores. In such settings, it is often common to receive large shipments of products contained in packaging containers that have been stacked directly onto wooden pallets. These pallets are easy to move around the store with a mechanical lift, and as such are often placed directly on the retail floor, for consumer resale, without first removing the containers from the pallets. In such situations, it is common to remove the plastic wrap or strapping that is used to secure the containers to the pallet and to one another during transit. Once this additional structural reinforcement has been removed, the stacked containers are again susceptible to leaning, falling or crushing one another, and the products contained therein.

In an attempt to provide stability in stacking display containers, some have resorted to inserting reinforcing panels along the center of the container. However, the presence of a centrally located panel, as seen in U.S. Pat. No. 5,826,728, significantly reduces the size of a product which can be shipped and displayed in the container. Alternatively, as exemplified in U.S. Pat. No. 5,839,650, some have resorted to reinforcing the side walls of the container with multiple plies of corrugated material and vertically extending tabs designed to engage the recesses in the display container stacked above. However, the multiple plies of corrugated material increase the manufacturing cost of such containers significantly. This large amount of corrugated material requires an extremely large initial material blank, and is therefore more challenging to form into a folded container. Also, the presence of vertically protruding tabs limits the ability to stack containers lacking recesses in the bottom panel, specially designed for receiving the specific configuration of tabs.

The present invention is intended to solve these and other drawbacks in the prior art. Therefore, it is an object of the present invention to provide a container that is reinforced by two side panels formed of an inner and outer panel and an air cell disposed therein between. It is another object of the present invention to provide a container that can be constructed so as to be well suited for displaying consumer goods and products by having at least one open side, but which also provides sufficient structural integrity as to withstand vertical stacking of multiple display containers without experiencing instability. Furthermore, it is yet another object of the present invention to provide such a container that is formed from a blank having a relatively small footprint.

SUMMARY OF THE INVENTION

The present invention provides a shipping and display container having a primary blank configured to form an exterior of the container and first and second secondary blanks configured to form a first and second interior side wall of the container respectively, wherein in a first configuration the first and second secondary blank are pivotably affixed to the primary blank in a substantially coplanar orientation; and wherein in a second configuration the first and second blanks are folded to form a tray, the tray having the primary blank forming a bottom wall, a front wall, a rear wall, a first exterior side wall, and a second exterior side wall, and the first and second secondary blanks forming first and second interior side walls offset from the first and second exterior side walls respectively, such that a void is provided between the interior side wall and the exterior side wall.

The present invention further provides a tray for shipping and display of a product, the tray having a primary blank folded to form a bottom wall, a front wall, a rear wall, a first exterior side wall, and a second exterior side wall; a first secondary blank affixed to the primary blank adjacent the first exterior side wall, the first secondary blank forming a first interior side wall offset from the first exterior side wall such that a void is provided between the first interior side wall and the first exterior side wall; and a second secondary blank affixed to the primary blank adjacent the second exterior side wall, the second secondary blank forming a second interior side wall offset from the second exterior side wall such that a void is provided between the second interior side wall and the second exterior side wall.

The present invention further provides a method of stacking display trays, comprising the steps of providing a first and second tray, each tray having a primary blank folded to form a bottom wall, a front wall, a rear wall, a first exterior side wall, and a second exterior side wall; a first secondary blank affixed to the primary blank adjacent the first exterior side wall, the first secondary blank forming a first interior side wall offset from the first exterior side wall, a first support panel disposed between the first interior side wall and the first exterior side wall, and a void provided between the first interior side wall and the first exterior side wall; and a second secondary blank affixed to the primary blank adjacent the second exterior side wall, the second secondary blank forming a second interior side wall offset from the second exterior side wall, a second support panel disposed between the second interior side wall and the second exterior side wall, and a void provided between the second interior side wall and the second exterior side wall; and placing the second tray on top of the first tray, such that the bottom wall of the second tray is supported by the first and second support panels of the first tray.

Various other features, objects and advantages of the present invention will be made apparent from the following detailed description of the drawing figures.

BRIEF DESCRIPTION OF THE DRAWINGS

The drawings illustrate a representative embodiment presently contemplated for carrying out the present invention. It should be understood that the invention is not limited to the embodiments disclosed, and is capable of variations within the scope of the appended claims.

In the drawings.

DETAILED DESCRIPTION

I. First Embodiment

Referring initially to FIGS. 1-6 there is shown a container 20A according to one embodiment of the present invention. The container 20A generally is made of a primary blank 22A or sheet and two secondary blanks 24A, 26A or sheets of packaging material. The packaging material may consist of corrugated board, cardboard, or any similar material suitable for use in shipping and display container construction. The corrugated board consists of a fluted corrugated core located between two sheets of kraft or recycled paper or linerboard, in a manner as is known. The primary blank 22A and secondary blanks 24A, 26A may be stamped or cut from the packaging material, while in a substantially flat orientation, and subsequently bound together and folded to form the container 20A in a manner to be explained.

The outer surface of the container 20A may be printed to display information such as contents details, shipping information, disassembly instructions, and the like. The outer surface of the container 20A may also contain advertising information, or ornamental elements.

Figure 1:
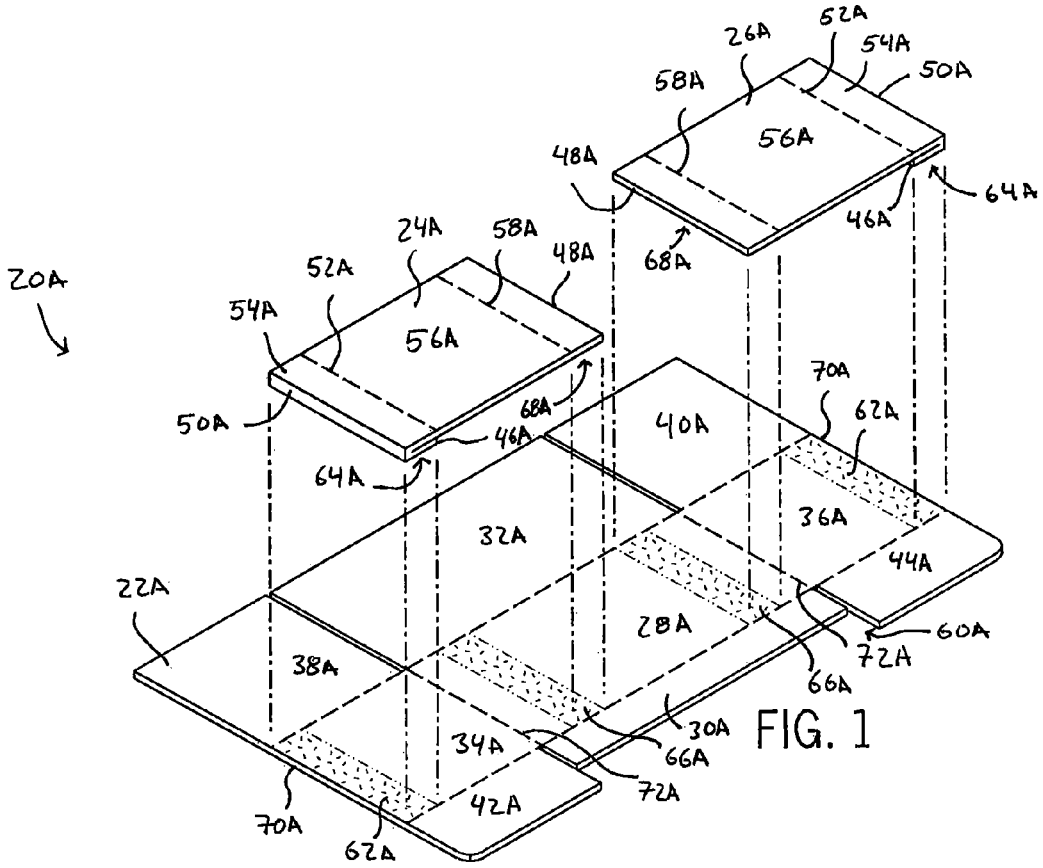
FIG. 1 is an exploded perspective view showing a container in an unfolded configuration, according to one aspect of the present invention.
Figure 2:
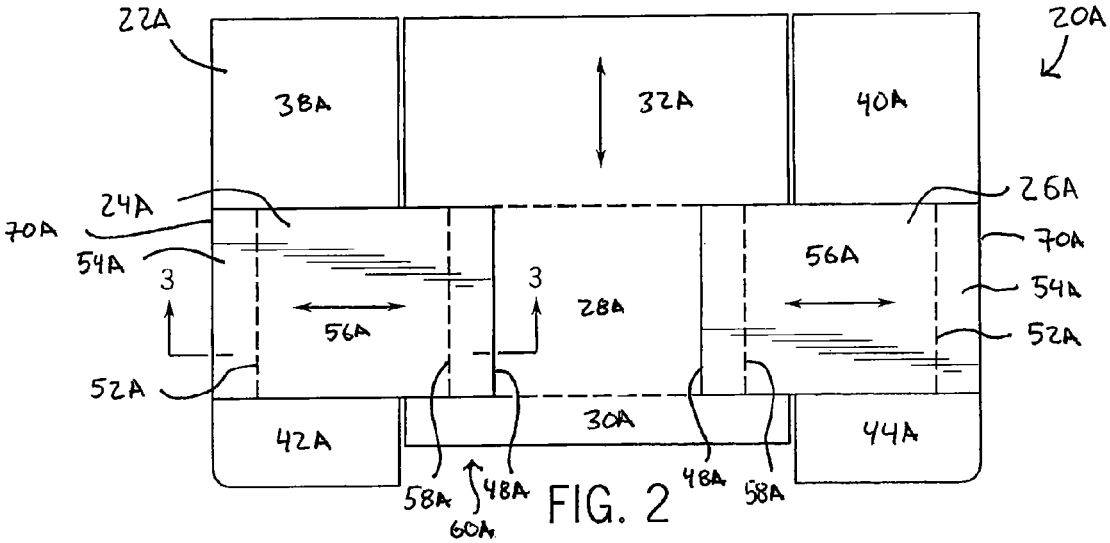
FIG. 2 is a top plan view of the unfolded container of FIG. 1.
Figure 4:
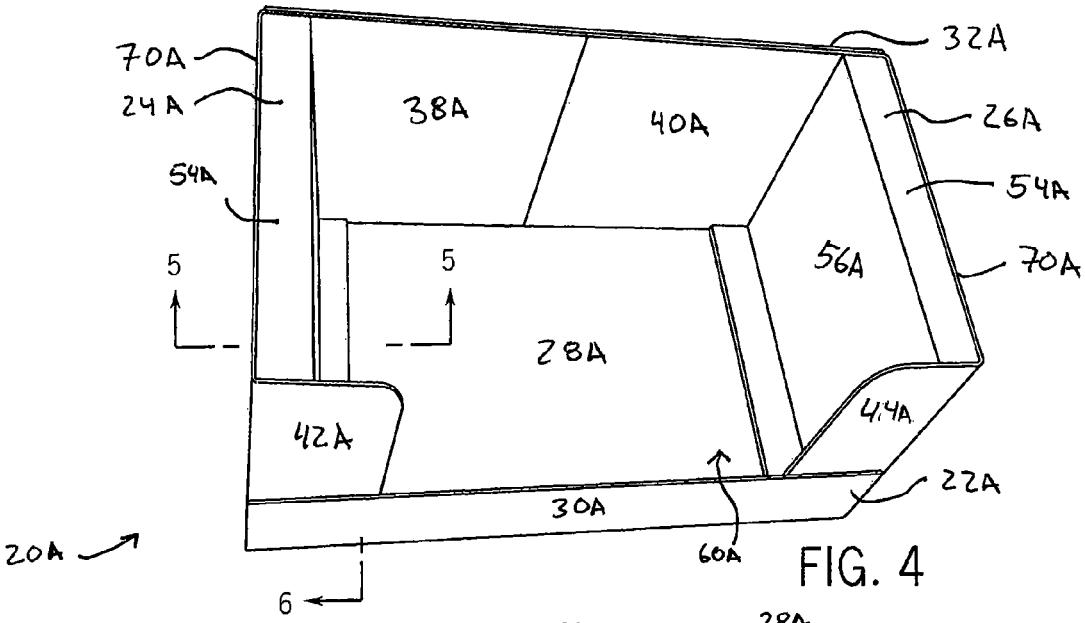
FIG. 4 is a perspective view of the container of FIG. 1, in a folded or erected configuration.
Figure 6:
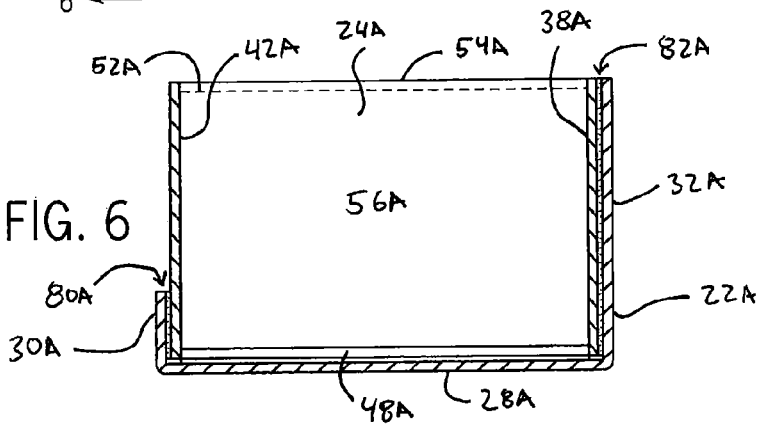
FIG. 6 is a cross-sectional view of the folded container of FIG. 4, along line 6-6 of FIG. 4.

FIGS. 1 and 2 illustrate the primary blank 22A, formed of a single piece of packaging material in a flat orientation. The primary blank 22A includes primarily a bottom panel 28A, a front panel 30A, a rear panel 32A, and two exterior side panels 34A, 36A. Exterior side panel 34A also includes a rear extension tab 38A, designed to engage the inner surface of the rear panel 32A when in a folded configuration, and a front extension tab 42A, designed to engage the inner surface of the front panel 30A when in a folded configuration. Similarly, the opposing exterior side panel 36A also includes a rear extension tab 40A, designed to engage the inner surface of the rear panel 32A when in a folded configuration, and a front extension tab 44A, designed to engage the inner surface of the front panel 30A when in a folded configuration. Additionally, as seen in FIGS. 1, 2 and 4, the container 20A may include a front panel 30A which extends to only a portion of the height of the adjacent side panels 34A, 36A, such that the void 60A is located above the front panel 30A, through which products may be seen and easily removed.

Figure 3:
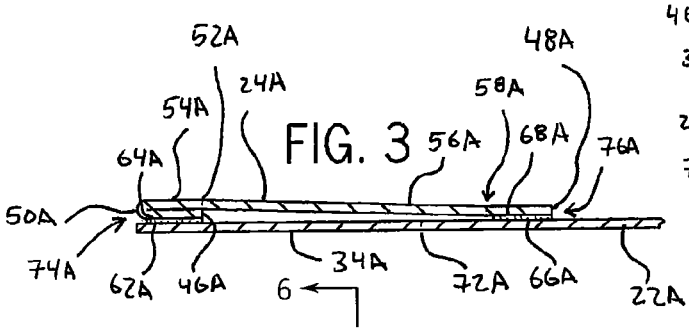
FIG. 3 is a partial cross-sectional view of the unfolded container of FIG. 1 along line 3-3 of FIG. 2.

FIGS. 1-3 illustrate the secondary blanks 24A, 26A, each of which are formed of a single piece of packaging material in a substantially flat configuration. Each secondary blank 24A, 26A includes an outer edge 46A and an inner edge 48A. First and second secondary blank fold lines 50A, 52A are located near the outer edge 46A, and define a support panel 54A there between. The secondary blanks 24A, 26A also include an interior side panel 56A, positioned between the second secondary blank fold line 52A and a third secondary blank fold line 58A. The area and size of the interior side panel 56A is approximately equal to that of the exterior side panel 34A, 36A of the primary blank 22A.

As seen in FIGS. 1-3 and 5, the first and second secondary blanks 24A, 26A are affixed to the inner surface of the primary blank 22A. The secondary blanks 24A, 26A are affixed to the inner surface of the primary blank 22A such that the footprints of the secondary blanks 24A, 26A are entirely located within the footprint of the primary blank 22A. An upper adhesive area 62A of the primary blank 22A is configured to receive an upper adhesive area 64A of the secondary blank 24A, 26A, while a lower adhesive area 66A of the primary blank 22A is configured to receive a lower adhesive area 68A of the secondary blank 24A, 26A. Adhesive areas 62A, 64A are configured to be attached to one another with adhesive 74A, while adhesive areas 66A, 68A are configured to be attached to one another with adhesive 76A. Adhesive 74A, 76A may consist of glue, tape, staples or any other bonding device that may be used to attach areas of shipping and packaging containers together. The upper adhesive area 62A of the primary blank 22A is located along an outermost edge 70A of the exterior side panel 34A, 36A. The lower adhesive area 66A of the primary blank 22A is located on the interior surface of the bottom panel 28A, within a bottom fold line 72A, which separates the bottom panel 28A from the side panel 34A, 36A. More specifically, the lower adhesive area 66A of the primary blank 22A is not directly adjacent the bottom fold line 72A, but rather is offset slightly from the fold line 72A by a distance approximately equal to the width of the support panel 54A.

Figure 5:
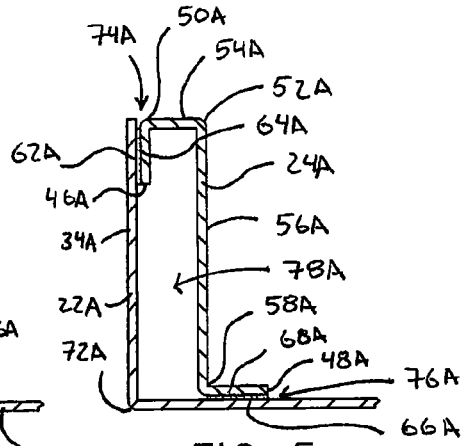
FIG. 5 is a partial cross-sectional view of the folded container of FIG. 4, along line 5-5 of FIG. 4.

With respect to the secondary blanks 24A, 26A, as seen in FIGS. 1, 3 and 5, the upper adhesive area 64A of each of secondary blanks 24A, 26A is located between the outer edge 46A of the secondary blank 24A, 26A and the support panel 54A, where the support panel 54A is defined as the area between the first secondary blank fold line 50A and the second secondary blank fold line 52A. The lower adhesive area 68A of the secondary blanks 24A, 26A is located on the opposite side of the respective secondary blank 24A, 26A as the upper adhesive area 64A, and is positioned adjacent the inner edge 48A of the secondary blank 24A, 26A. The lower adhesive area 68A of each secondary blank 24A, 26A is simultaneously positioned adjacent the third secondary blank fold line 58A.

As illustrated in the cross sectional view of FIGS. 3 and 5, the primary blank 22A and secondary blanks 24A, 26A will now be described in an attached configuration. The upper adhesive area 62A of the primary blank 22A is configured to receive the upper adhesive area 64A of each secondary blank 24A, 26A, while the lower adhesive area 66A of the primary blank 22A is configured to receive the lower adhesive area 68A of each secondary blank 24A, 26A. As previously indicated, adhesive areas 62A, 64A are configured to be attached to one another with adhesive 74A, while adhesive areas 66A, 68A are configured to be attached to one another with adhesive 76A. Due to the adhesive areas 64A, 68A of the secondary blanks 24A, 26A being located on opposite surfaces of the given secondary blank 24A, 26A, each secondary blank 24A, 26A is folded approximately 180 degrees about the first secondary blank fold line 50A, when the container is in an unfolded, i.e. substantially flat configuration, as seen in FIG. 3. The blanks 22A, 24A, 26A are configured such that the fold lines 50A, 52A, 58A of the secondary blanks 24A, 26A do not overlap the bottom fold line 72A of the primary blank 22A between the exterior side panel 34A, 36A and the bottom panel 28A. Rather the blanks 22A, 24A, 26A are configured such that the third secondary blank fold line 58A is offset from the bottom fold line 72A of the primary blank 22A, by a distance approximately equal to the width of the support panel 54A, i.e. the distance between the first secondary blank fold line 50A and second secondary fold line 52A. The locations of the relative adhesive areas 62A, 64A, 66A, 68A are further illustrated in FIG. 1.

Having been attached while in a flat configuration, as illustrated in FIGS. 1 and 3, the primary blank 22A and secondary blanks 24A, 26A may subsequently be placed in an erected or folded configuration to form container 20A, in order to receive contents therein. Folding of the blanks 22A, 24A, 26A forces the areas adjacent the first, second, and third secondary blank fold lines 50A, 52A, 58A, respectively, to be oriented at approximately 90 degree angles. Specifically, the arrows indicated on panels 32A and 56A, as seen in FIG. 2 indicate the relative direction of rotation of the panels, as they are folded into an erected configuration. Accordingly, as seen in FIG. 5, the interior side panel 56A and each of the exterior side panels 34A, 36A are oriented parallel relative to one another, separated by an air cell 78A having a width approximately equal to the length of the support panel 54A. The support panels 54A of the opposing secondary blanks 24A, 26A thereby form an area perpendicular to the surface on which the container 20A is set, and provides a greater surface area on which to receive the weight of any additional containers 20A which may be placed on top of the container 20A. The container 20A is retained in a folded configuration by means of multiple adhesive points. These adhesive points may include a front adhesive point 80A, located between the front panel 30A and the front extension tabs 42A, 44A, and a rear adhesive point 82A, located between the rear panel 32A and the rear extension tabs 38A, 40A, as illustrated in cross sectional FIG. 6. Each side of the container 20A may include a front and rear adhesive point 80A, 82A, respectively, such that a total of four adhesive points retain the container 20A in the folded configuration. Alternatively, the rear extension tabs 38A, 40A may be located exterior, relative to the rear panel 32A, when in the folded configuration. Similarly, the front extension tabs 42A, 44A may be located exterior, relative to the front panel 30A, when in the folded configuration. Furthermore, it is understood that container 20A may be maintained in the folded or erected configuration in any other manner, such as by tape, staples, etc.

II. Second Embodiment

Figure 10:
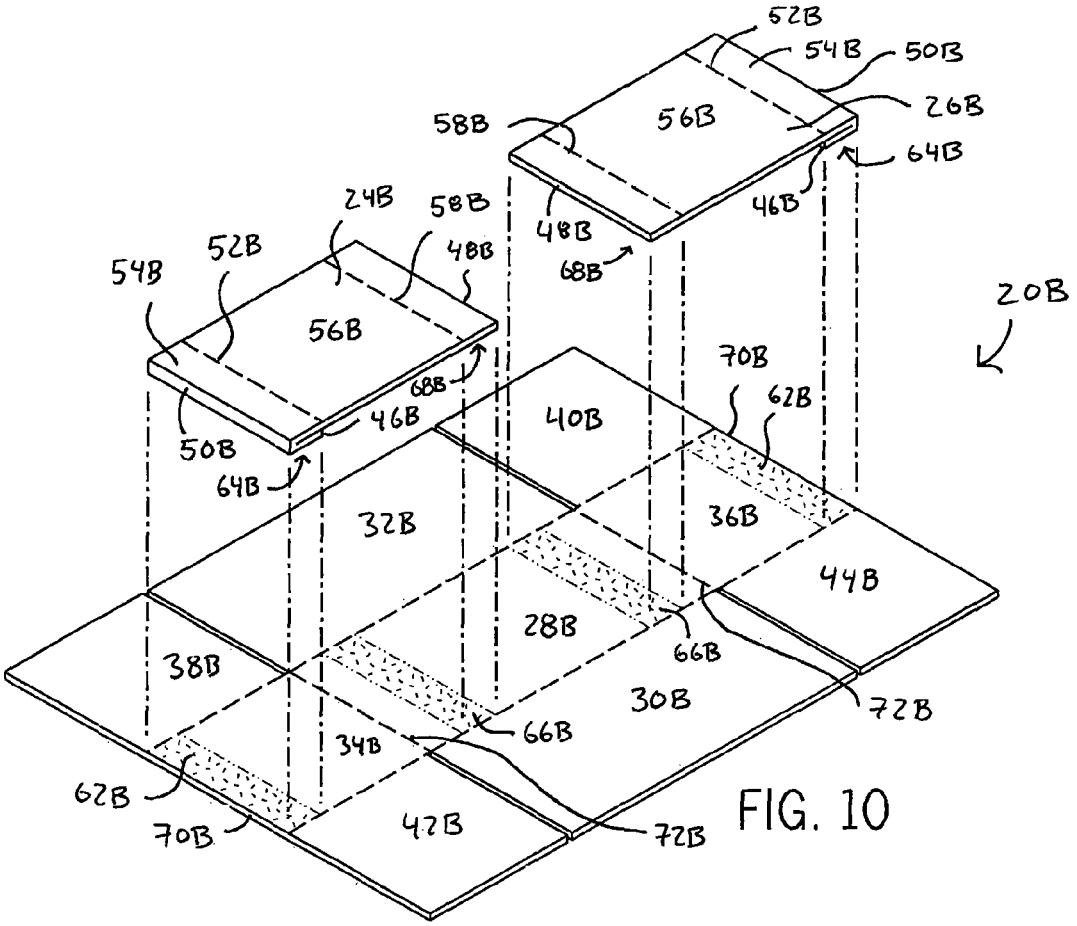
FIG. 10 is an exploded perspective view showing a container in an unfolded configuration, according to another embodiment of the present invention.
Figure 11:
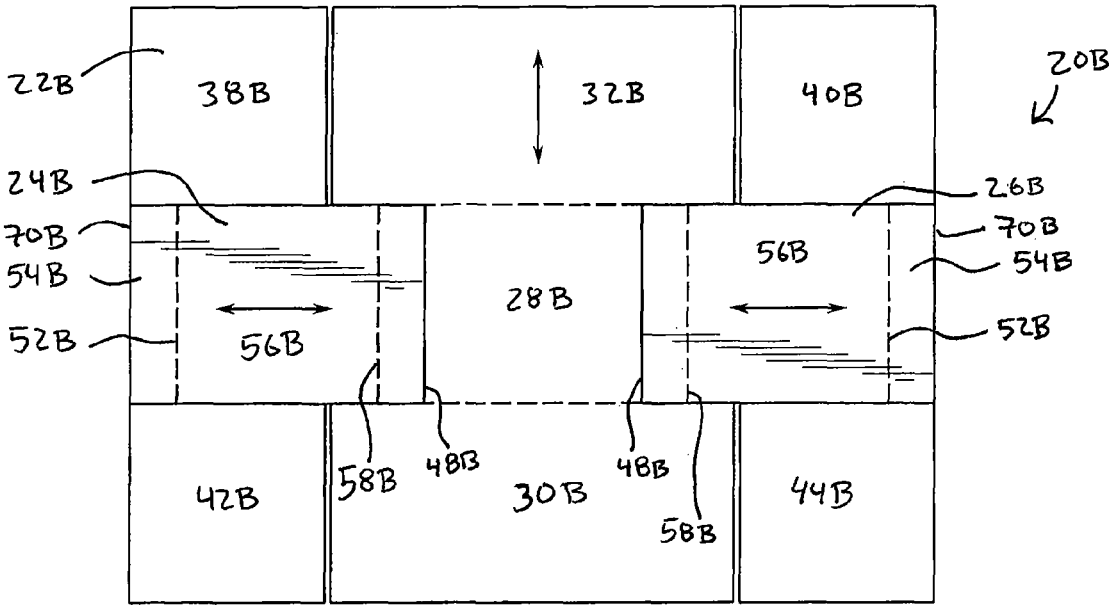
FIG. 11 is a top plan view of the unfolded container of FIG. 10.
Figure 12:
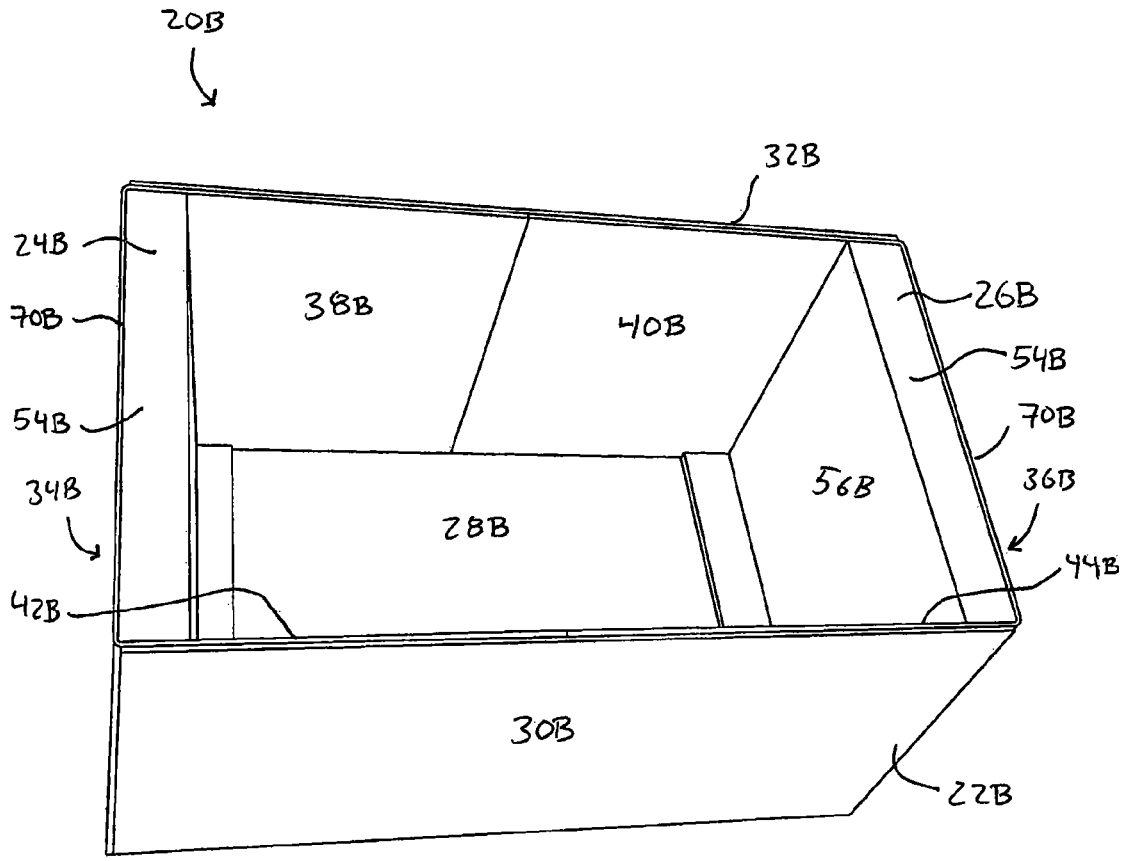
FIG. 12 is a perspective view of the container of FIG. 10, in a folded or erected configuration.

In an alternative embodiment, as illustrated in FIGS. 10-12 container 20B may contain a front panel 30B having a height consistent with that of rear panel 32B and exterior side panels 34B, 36B. Resultantly, in a folded configuration, container 20B may provide an upper edge of consistent height about all four sides of the container 20B. Specifically, container 20B may be formed of a primary blank 22B and secondary blanks 24B, 26B. The primary blank 22B includes primarily a bottom panel 28B, a front panel 30B, a rear panel 32B, and two exterior side panels 34B, 36B. Exterior side panel 34B also includes a rear extension tab 38B, designed to engage the inner surface of the rear panel 32B when in a folded configuration, and a front extension tab 42B, designed to engage the inner surface of the front panel 30B when in a folded configuration. Similarly, the opposing exterior side panel 36B also includes a rear extension tab 40B, designed to engage the inner surface of the rear panel 32B when in a folded configuration, and a front extension tab 44B, designed to engage the inner surface of the front panel 30B when in a folded configuration. Alternatively, the rear extension tabs 38B, 40B may engage the outer surface of the rear panel 32B, and the front extension tabs 42B, 44B may engage the outer surface of the front panel 30B.

In this embodiment, each secondary blank 24B, 26B includes an outer edge 46B and an inner edge 48B. First and second secondary blank fold lines 50B, 52B are located near the outer edge 46B, and define a support panel 54B therebetween. The secondary blanks 24B, 26B also include an interior side panel 56B, positioned between the second secondary blank fold line 52B and a third secondary blank fold line 58B. The area and size of the interior side panel 56B is approximately equal to that of the exterior side panel 34B, 36B of the primary blank 22B.

As seen in FIG. 10, the first and second secondary blanks 24B, 26B are affixed to the inner surface of the primary blank 22B. The secondary blanks 24B, 26B are affixed to the inner surface of the primary blank 22B such that the footprints of the secondary blanks 24B, 26B are entirely located within the footprint of the primary blank 22B. An upper adhesive area 62B of the primary blank 22B is configured to receive an upper adhesive area 64B of the secondary blank 24B, 26B, while a lower adhesive area 66B of the primary blank 22B is configured to receive a lower adhesive area 68B of the secondary blank 24B, 26B. Adhesive areas 62B, 64B are configured to be attached to one another with adhesive (not shown), while adhesive areas 66B, 68B are similarly configured to be attached to one another with an adhesive (not shown). The adhesive may consist of glue, tape, staples or any other bonding device that is used to attach areas of shipping and packaging containers together. The upper adhesive area 62B of the primary blank 22B is located along an outermost edge 70B of the exterior side panel 34B, 36B. The lower adhesive area 66B of the primary blank 22B is located on the interior surface of the bottom panel 28B, within a bottom fold line 72B, which separates the bottom panel 28B from the side panel 34B, 36B. More specifically, the lower adhesive area 66B of the primary blank 22B is not directly adjacent the bottom fold line 72B, but rather is offset slightly from the fold line 72B by a distance approximately equal to the width of the support panel 54B.

Having been attached while in a flat configuration, as illustrated in FIGS. 10 and 11 and discussed in the preceding paragraph, the primary blank 22B and secondary blanks 24B, 26B may subsequently be placed in an erected or folded configuration to form container 20B, in order to receive contents therein. Folding of the blanks 22B, 24B, 26B forces the areas adjacent the first, second, and third secondary blank fold lines 50B, 52B, 58B, respectively, to be oriented at approximately 90 degree angles. Specifically, the arrows indicated on panels 32B and 56B, as seen in FIG. 11 indicate the relative direction of rotation of the panels, as they are folded into an erected configuration. Accordingly, as seen in FIG. 12, the interior side panel 56B and exterior side panel 34B, 36B are oriented parallel relative to one another, separated by an air cell having a width approximately equal to the length of the support panel 54B. The support panels 54B of the opposing secondary blanks 24B, 26B thereby form an area parallel to the surface on which the container 20B is set, and provide a greater surface area on which to receive the weight of any additional containers 20B which may be placed on top of the container 20B. Additionally, the upper edge of container 20B, formed from the uppermost edges of the rear panel 32B, exterior side panels 34B, 36B, and frontal panel 30B extend to a height approximately equal to the panel of the upper support panel 54B, thereby providing additional structural support to container 20B. The container 20B is retained in a folded configuration by means of multiple adhesive points. These adhesive points may include a front adhesive point, located between the front panel 30B and the front extension tabs 42B, 44B, and a rear adhesive point, located between the rear panel 32B and the rear extension tabs 38B, 40B. Each side of the container 20B may include a front and rear adhesive point respectively, such that a total of four adhesive points retain the container 20B in the folded configuration. Alternatively, the rear extension tabs 38B, 40B may be located exterior, relative to the rear panel 32B, when in the folded configuration. Similarly, the front extension tabs 42B, 44B may be located exterior, relative to the front panel 30B, when in the folded configuration. Furthermore, it is understood that container 20B may be maintained in the folded or erected configuration in any other manner, such as by tape, staples, etc.

III. Third Embodiment

Figure 16:
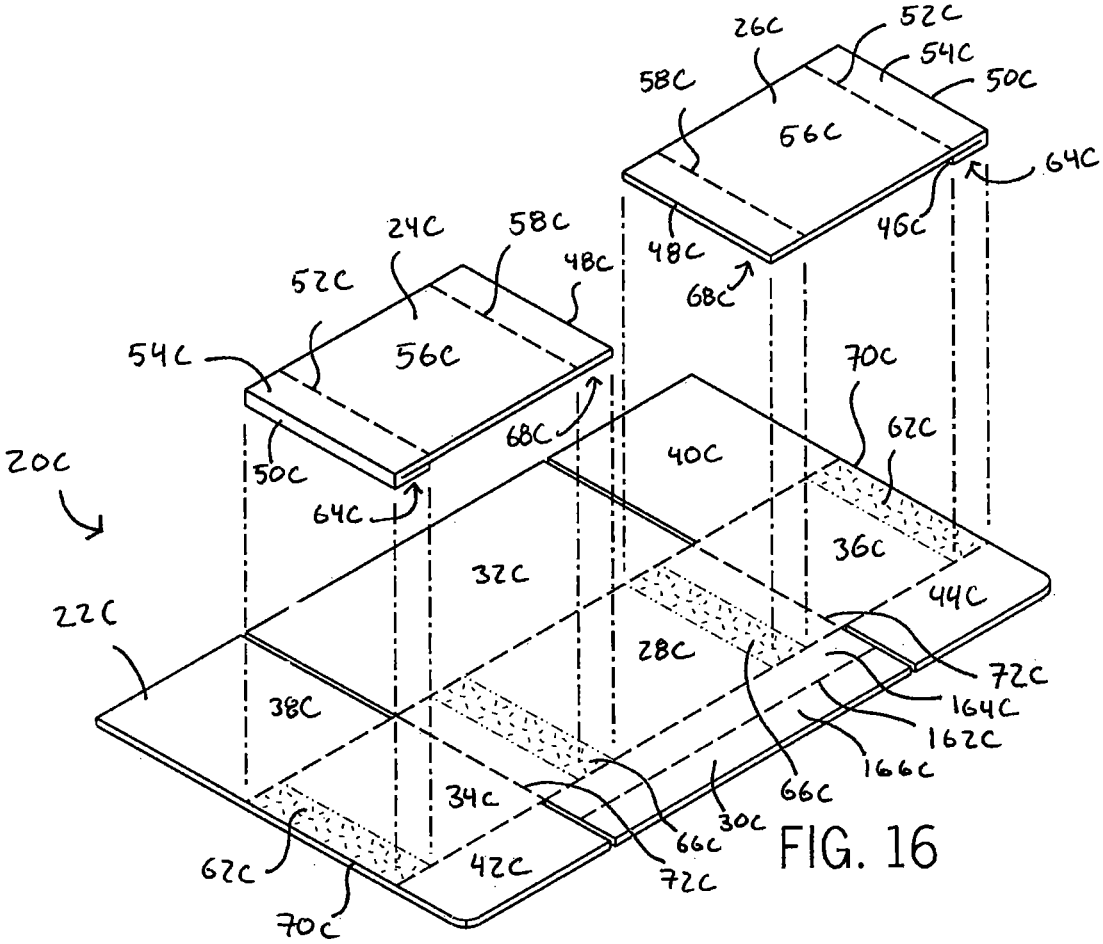
FIG. 16 is an exploded perspective view showing a container in an unfolded configuration, according to another embodiment of the present invention.
Figure 17:
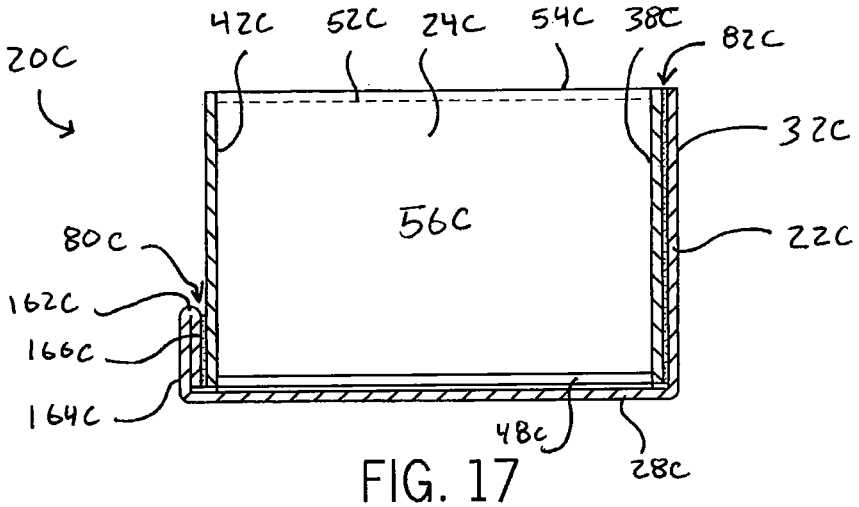
FIG. 17 is a cross-sectional view of the folded or erected container of FIG. 16.

In another alternative embodiment, as illustrated in FIGS. 16-17 container 20C may contain a front panel 30C consisting of a first face 164C and a second face 166C, wherein the first face 164C is separated from the second face 166C along a fold line 162C. Resultantly, in a folded configuration, container 20C may provide a front panel 30C wherein the second face 166C is folded about fold line 162C, to engage the first face 164C. This folded configuration may thereby result in a container 20C where the upper edge of the front panel 30C is formed of a smooth or perforated fold line 162C, rather than an exposed cut line. As such, this embodiment removes the rough exposed cut line about the upper edge of the front panel 30C, which provides a more finished appearance.

More specifically, container 20C of this embodiment may be formed of a primary blank 22C and secondary blanks 24C, 26C. The primary blank 22C includes primarily a bottom panel 28C, a front panel 30C, a rear panel 32C, and two exterior side panels 34C, 36C. Exterior side panel 34C also includes a rear extension tab 38C, designed to engage the inner surface of the rear panel 32C when in a folded configuration, and a front extension tab 42C, designed to engage the inner surface of the front panel 30C, and particularly the second face 166C thereof, when in a folded configuration. Similarly, the opposing exterior side panel 36C also includes a rear extension tab 40C, designed to engage the inner surface of the rear panel 32C when in a folded configuration, and a front extension tab 44C, designed to engage the inner surface of the front panel 30C, and particularly the second face 166C thereof, when in a folded configuration. Alternatively, the rear extension tabs 38C, 40C may engage the outer surface of the rear panel 32C, and the front extension tabs 42C, 44C may engage the outer surface of the front panel 30C.

In this embodiment, each secondary blank 24C, 26C includes an outer edge 46C and an inner edge 48C. First and second secondary blank fold lines 50C, 52C are located near the outer edge 46C, and define a support panel 54C therebetween. The secondary blanks 24C, 26C also include an interior side panel 56C, positioned between the second secondary blank fold line 52C and a third secondary blank fold line 58C. The area and size of the interior side panel 56C is approximately equal to that of the exterior side panel 34C, 36C of the primary blank 22C.

As seen in FIG. 16 the first and second secondary blanks 24C, 26C are affixed to the inner surface of the primary blank 22C. The secondary blanks 24C, 26C are affixed to the inner surface of the primary blank 22C such that the footprints of the secondary blanks 24C, 26C are entirely located within the footprint of the primary blank 22C. An upper adhesive area 62C of the primary blank 22C is configured to receive an upper adhesive area 64C of the secondary blank 24C, 26C, while a lower adhesive area 66C of the primary blank 22C is configured to receive a lower adhesive area 68C of the secondary blank 24C, 26C. Adhesive areas 62C, 64C are configured to be attached to one another with adhesive (not shown), while adhesive areas 66C, 68C are similarly configured to be attached to one another with an adhesive (not shown). The adhesive may consist of glue, tape, staples or any other bonding device that is used to attach areas of shipping and packaging containers together. The upper adhesive area 62C of the primary blank 22C is located along an outermost edge 70C of the exterior side panel 34C, 36C. The lower adhesive area 66C of the primary blank 22C is located on the interior surface of the bottom panel 28C, within a bottom fold line 72C, which separates the bottom panel 28C from the side panel 34C, 36C. More specifically, the lower adhesive area 66C of the primary blank 22C is not directly adjacent the bottom fold line 72C, but rather is offset slightly from the fold line 72C by a distance approximately equal to the width of the support panel 54C.

Having been attached while in a flat configuration, as illustrated in FIG. 16, the primary blank 22C and secondary blanks 24C, 26C may subsequently be placed in an erected or folded configuration to form container 20C, in order to receive contents therein, in a manner consistent with the previously discussed embodiments. Folding of the blanks 22C, 24C, 26C forces the areas adjacent the first, second, and third secondary blank fold lines 50C, 52C, 58C, respectively, to be oriented at approximately 90 degree angles. Accordingly the interior side panel 56C and exterior side panel 34C, 36C are oriented parallel relative to one another, separated by an air cell having a width approximately equal to the length of the support panel 54C. The support panels 54C of the opposing secondary blanks 24C, 26C thereby form an area perpendicular to the surface on which the container 20C is set, and provides a greater surface area on which to receive the weight of any additional containers 20C which may be placed on top of the container 20C. Additionally, the upper edge of container 20C, formed from the upper most edges of the rear panel 32C, and exterior side panels 34C, 36C provide additional structural support to container 20C. The container 20C is retained in a folded configuration by means of multiple adhesive points. These adhesive points may include a front adhesive point 80C, located between the front panel 30C and the front extension tabs 42C, 44C, and a rear adhesive point 82C, located between the rear panel 32C and the rear extension tabs 38C, 40C. Each side of the container 20C may include a front and rear adhesive point 80C, 82C respectively, such that a total of four adhesive points retain the container 20C in the folded configuration. Furthermore, when folded, the second face 166C of the front panel 30C may engage the front extension tabs 42C, 44C, as illustrated in FIG. 17. Alternatively, the front panel 30C may be located within the container 20C such that the first face 164C engages the interior of the front extension tabs 42C, 44C at the adhesive point 80C. To provide additional support, the first face 164C may be affixed to the second face 166C to maintain their folded configuration. In addition to the use of adhesive or glue, it is understood that container 20C may be maintained in the folded or erected configuration in any other manner, such as by tape, staples, etc.

IV. Fourth Embodiment

Figure 18:
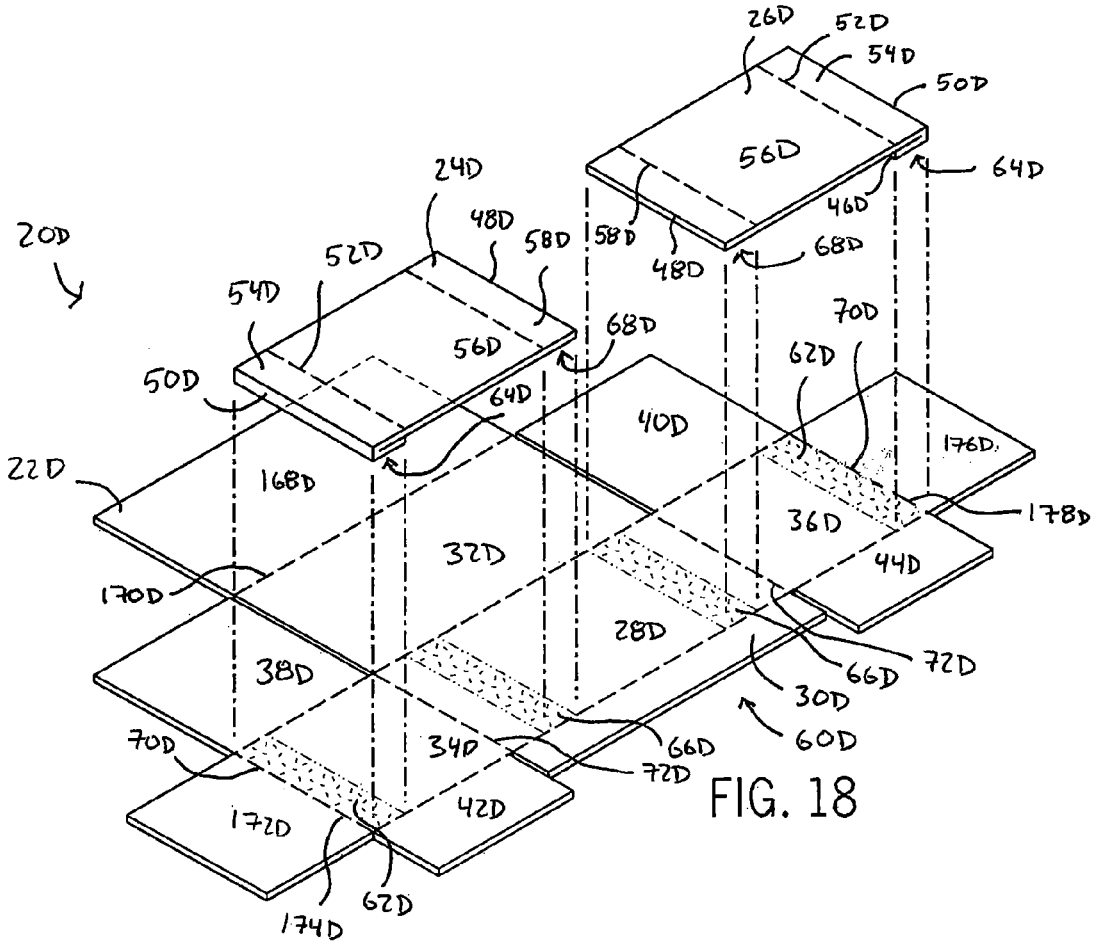
FIG. 18 is an exploded perspective view showing a container in an unfolded configuration, according to another embodiment of the present invention.
Figure 19:
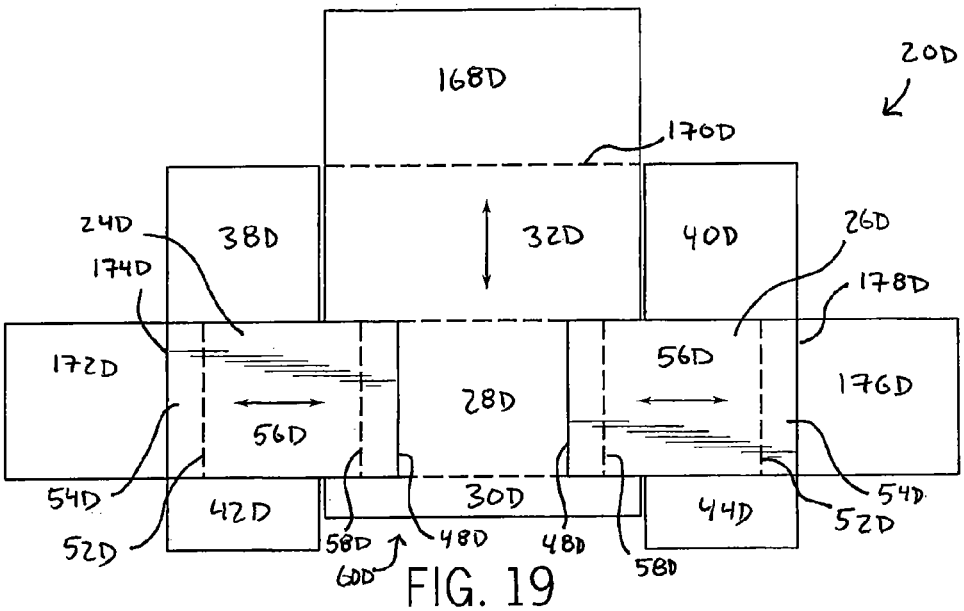
FIG. 19 is a top plan view of the unfolded container of FIG. 18.
Figure 20:
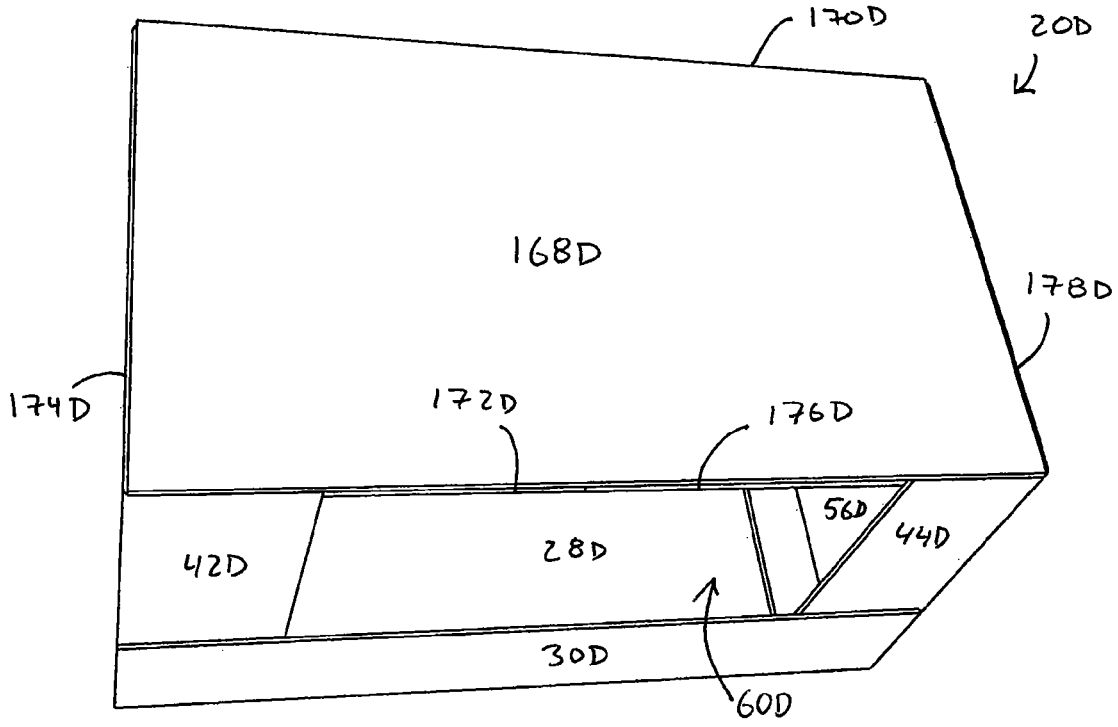
FIG. 20 is a perspective view of the container of FIG. 18, in a folded or erected configuration.

In another alternative embodiment, as illustrated in FIGS. 18-20 container 20D may contain a rear top panel 168D. In this embodiment, the rear panel 32D of the primary blank 22D may be contiguous with the rear top panel 168D, separated from the rear panel 32D along rear panel upper fold line 170D. This rear top panel 168D may be approximately equal to the size of the base panel 28D such that it fully covers the top of the container 20D. The rear top panel 168D may be included in embodiments of the container 20D intended to be used in shipping or stacking, which therefore benefit from the additional structural strength or enclosure provided by top panel 168D. The rear top panel 168D may be removably separated from the rear panel 32D along the rear panel upper fold line 170D. To facilitate removal of the top panel, the rear panel upper fold line 170D may include a series of perforations in the packaging material. Additionally, side panel 34D may contain a top extension tab 172D, separated from the side panel 24D along the side panel upper fold line 174D, while side panel 36D may contain a top extension tab 176D, separated from the side panel 26D along the side panel upper fold line 178D. Top extension tabs 172D, 176D are configured to engage the underside of the rear top panel 168D, when the container 20D is in a folded configuration. As illustrated in FIG. 20, top extension tabs 172D, 176D may extend approximately half the length of the container 20D, such that their respective outermost edges meet when in a folded configuration. Alternatively, the top extension tabs 172D, 176D may extend less than half the length of the container 20D. As with the rear top panel 168D, the top extension tabs 172D, 176D, may be removed from side panels 34D, 36D at the upper fold lines 70D, which may include a series of perforations in the packaging material.

Furthermore, container 20D of this embodiment may be formed of a primary blank 22D and secondary blanks 24D, 26D. The primary blank 22D includes primarily a bottom panel 28D, a front panel 30D, a rear panel 32D, and two exterior side panels 34D, 36D. The front panel 30D may extend to only a portion of the height of the adjacent side panels 34D, 36D, such that the void 60D is located above the front panel 30D, through which products may be seen and easily removed. Exterior side panel 34D also includes a rear extension tab 38D, designed to engage the inner surface of the rear panel 32D when in a folded configuration, and a front extension tab 42D, designed to engage the inner surface of the front panel 30D when in a folded configuration, as well as the previously discussed top extension tab 172D. Similarly, the opposing exterior side panel 36D also includes a rear extension tab 40D, designed to engage the inner surface of the rear panel 32D when in a folded configuration, and a front extension tab 44D, designed to engage the inner surface of the front panel 30D when in a folded configuration, as well as the previously discussed top extension tab 176D. Alternatively, the rear extension tabs 38D, 40D may engage the outer surface of the rear panel 32D, and the front extension tabs 42D, 44D may engage the outer surface of the front panel 30D.

In this embodiment, each secondary blank 24D, 26D includes an outer edge 46D and an inner edge 48D. First and second secondary blank fold lines 50D, 52D are located near the outer edge 46D, and define a support panel 54D therebetween. The secondary blanks 24D, 26D also include an interior side panel 56D, positioned between the second secondary blank fold line 52D and a third secondary blank fold line 58D. The area and size of the interior side panel 56D is approximately equal to that of the exterior side panel 34D, 36D of the primary blank 22D.

As seen in FIG. 18, the first and second secondary blanks 24D, 26D are affixed to the inner surface of the primary blank 22D. The secondary blanks 24D, 26D are affixed to the inner surface of the primary blank 22D such that the footprints of the secondary blanks 24D, 26D are entirely located within the footprint of the primary blank 22D. An upper adhesive area 62D of the primary blank 22D is configured to receive an upper adhesive area 64D of the secondary blank 24D, 26D, while a lower adhesive area 66D of the primary blank 22D is configured to receive a lower adhesive area 68D of the secondary blank 24D, 26D. Adhesive areas 62D, 64D are configured to be attached to one another with adhesive (not shown), while adhesive areas 66D, 68D are similarly configured to be attached to one another with an adhesive (not shown). The adhesive may consist of glue, tape, staples or any other bonding device that is used to attach areas of shipping and packaging containers together. The upper adhesive area 62D of the primary blank 22D is located along an outermost edge 70D of the exterior side panel 34D, 36D, which also forms the side panel upper fold line 174D, 178D respectively. The lower adhesive area 66D of the primary blank 22D is located on the interior surface of the bottom panel 28D, within a bottom fold line 72D, which separates the bottom panel 28D from the side panel 34D, 36D. More specifically, the lower adhesive area 66D of the primary blank 22D is not directly adjacent the bottom fold line 72D, but rather is offset slightly from the fold line 72D by a distance approximately equal to the width of the support panel 54D.

Having been attached while in a flat configuration, as illustrated in FIGS. 18 and 19 and discussed in the preceding paragraph, the primary blank 22D and secondary blanks 24D, 26D may subsequently be placed in an erected or folded configuration to form container 20D, in order to receive contents therein. Folding of the blanks 22D, 24D, 26D forces the areas adjacent the first, second, and third secondary blank fold lines 50D, 52D, 58D, respectively, to be oriented at approximately 90 degree angles. Specifically, the arrows indicated on panels 32D and 56D, as seen in FIG. 19 indicate the relative direction of rotation of the panels, as they are folded into an erected configuration. Furthermore, the rear top panel 168D is folded about fold line 170D, such that rear top panel 168D covers the top of container 20D, and rests on support panels 54D. In this folded configuration, the interior side panel 56D and exterior side panels 34D, 36D are oriented parallel relative to one another, separated by an air cell having a width approximately equal to the length of the support panel 54D. The support panels 54D of the opposing secondary blanks 24D, 26D thereby form an area parallel to the surface on which container 20D is set, and provides a greater surface area on which to receive the weight of any additional containers 20D which may be placed on top of the container 20D. Additionally, the upper edge of container 20D, formed from the upper most edges of the rear panel 32D, and exterior side panels 34D, 36D provide additional structural support to container 20D, as does the rear top panel 168D and top extension tabs 172D, 176D. The container 20D is retained in a folded configuration by means of multiple adhesive points. These adhesive points may include a front adhesive point, located between the front panel 30D and the front extension tabs 42D, 44D, and a rear adhesive point, located between the rear panel 32D and the rear extension tabs 38D, 40D. Each side of the container 20D may include a front and rear adhesive point respectively, such that a total of four adhesive points retain the container 20D in the folded configuration. Furthermore, rear top panel 168D may be affixed to the top extension tabs 172D, 176D and/or exterior side panels 34D, 36D. It is also understood, that container 20D may be maintained in the folded or erected configuration in any other manner, such as by tape, staples, etc.

V. Fifth Embodiment

Figure 21:
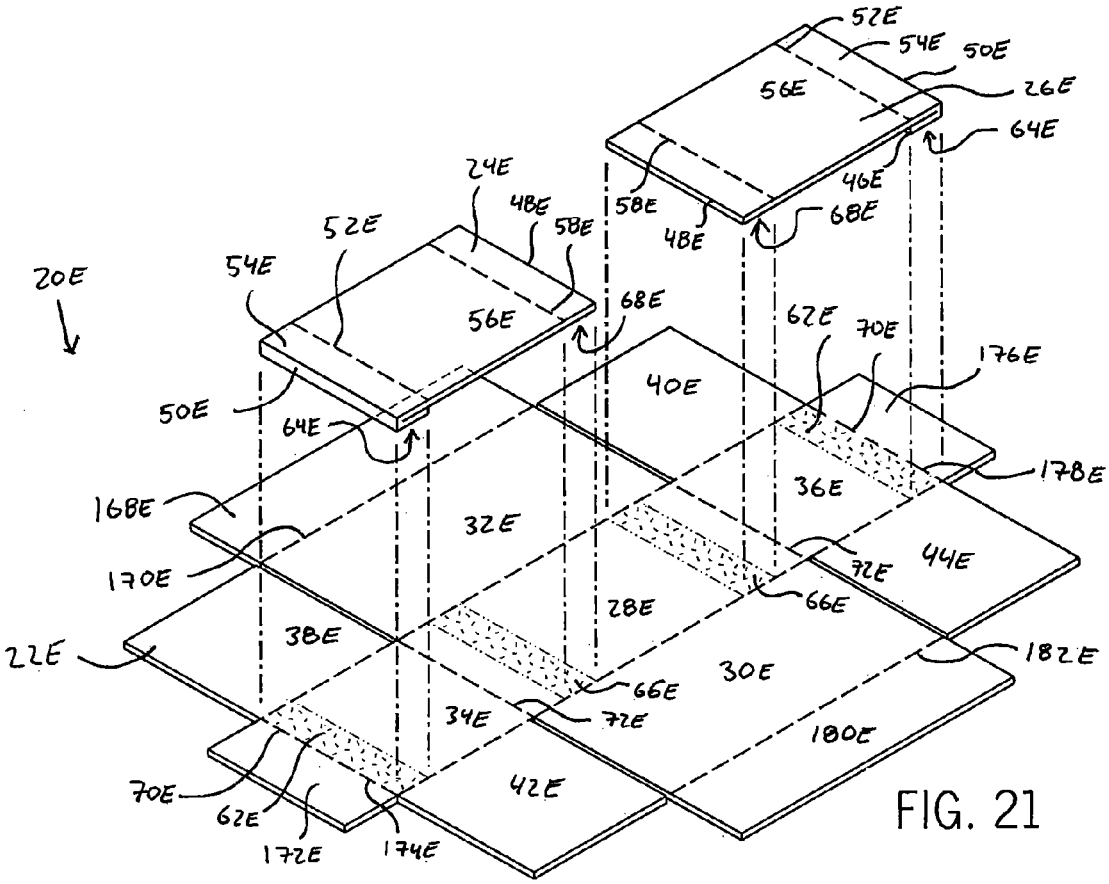
FIG. 21 is an exploded perspective view showing a container in an unfolded configuration, according to another embodiment of the present invention.
Figure 22:
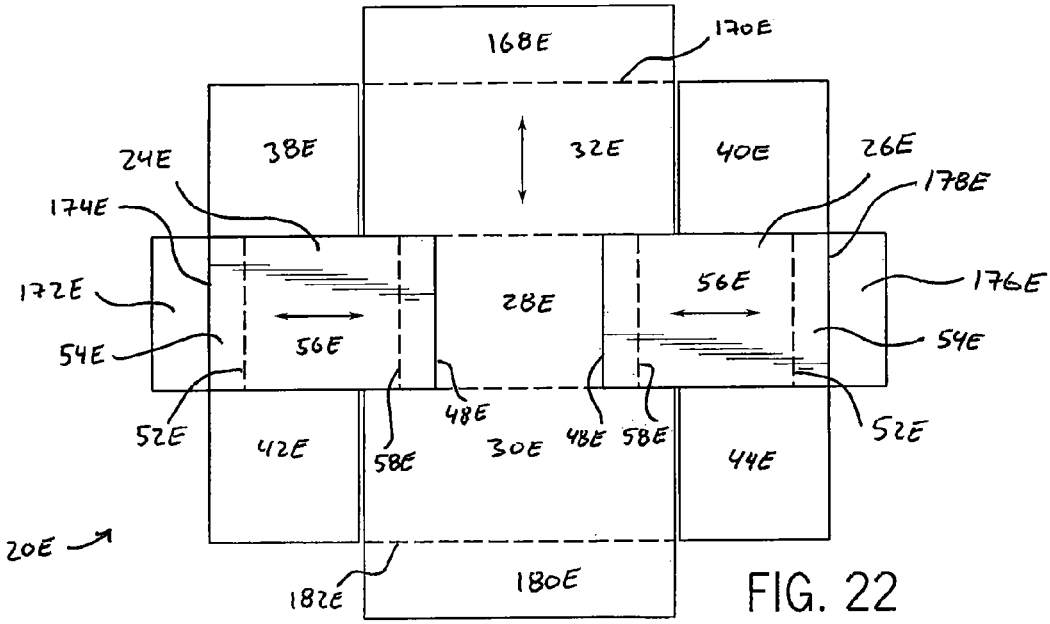
FIG. 22 is a top plan view of the unfolded container of FIG. 21.
Figure 23:
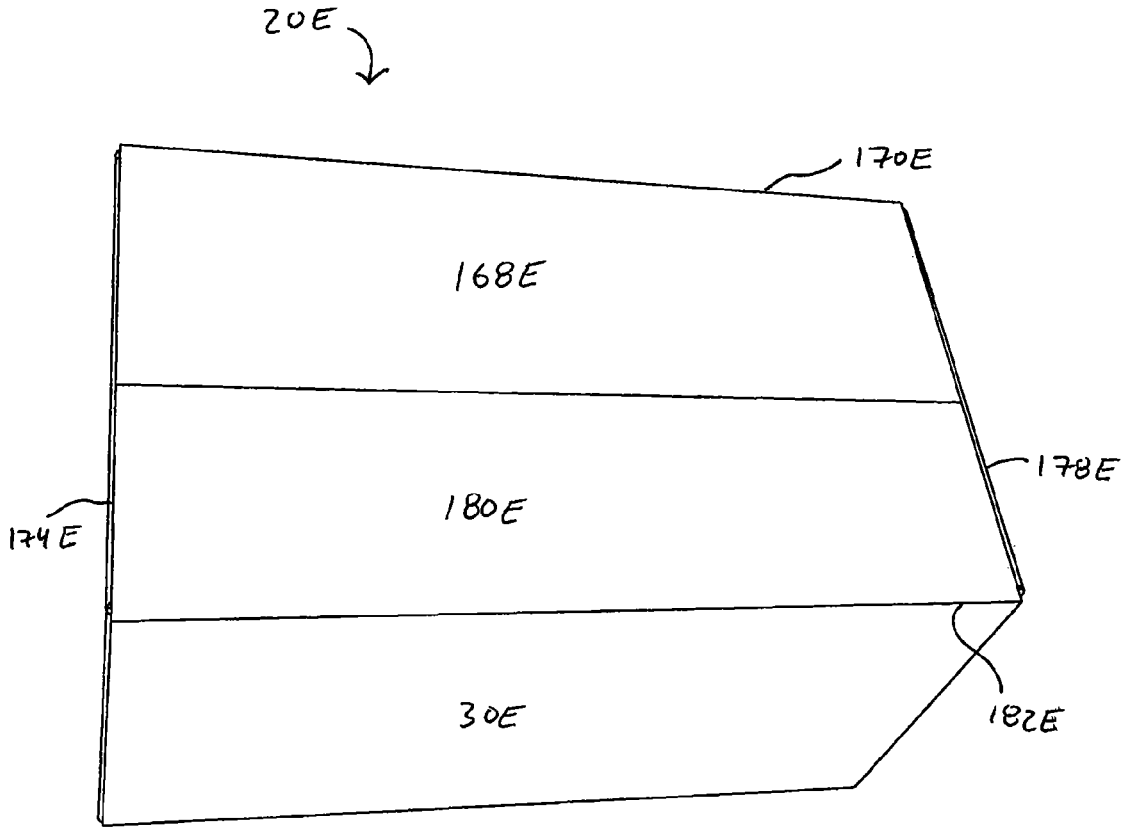
FIG. 23 is a perspective view of the container of FIG. 21, in a folded or erected configuration.

In yet another alternative embodiment, as illustrated in FIGS. 21-23, container 20E may contain a rear top panel 168E and a front top panel 180E. In this embodiment, the rear panel 32E of the primary blank 22E may be contiguous with the rear top panel 168E, separated from the rear panel 32E along rear panel upper fold line 170E. Similarly, the front top panel 180E may be contiguous with the front panel 30E, and separated from the front panel along front panel upper fold line 182E. To accommodate the presence of the front top panel 180E, the front panel 30E, either entirely, or a portion thereof, may have an extended height, such that the front panel upper fold line 182E is positioned at the upper edge of the container 20E, when in a folded configuration. Additionally, side panel 34E may contain a top extension tab 172E, separated from the side panel 34E along the side panel upper fold line 174E, while side panel 36E may contain a top extension tab 176E, separated from the side panel 26E along the side panel upper fold line 178E. Top tabs 172E, 176E are configured to engage the underside of the top panels 168E, 180E when the container 20E is in a folded configuration. The top extension tabs 172E, 176E may extend approximately half the length of the container 20E, such that their respective outermost edges meet when in a folded configuration. Alternatively, the top extension tabs 172E, 176E may extend less than half the length of the container 20E, as illustrated in FIGS. 21-22.

The top panels 168E, 180E may be included in embodiments of the container 20E intended to be used in shipping or stacking, which benefit from the additional structural strength or enclosure provided by top panels 168E, 180E. The top panels 168E, 180E may be removably separated from the rear panel 32E and front panel 30E respectively, along the rear panel upper fold line 170E and front panel upper fold line 182E. To facilitate removal of the top panels 168E, 180E, the upper fold lines 170E, 182E may include a series of perforations. Similarly, the top extension tabs 172E, 176E may be removed from their side panels 34E, 36E along perforated upper fold lines 174E, 178E respectively.

More specifically, container 20E of this embodiment may be formed of a primary blank 22E and secondary blanks 24E, 26E. The primary blank 22E includes primarily a bottom panel 28E, a front panel 30E, a rear panel 32E, and two exterior side panels 34E, 36E. Exterior side panel 34E also includes a rear extension tab 38E, designed to engage the inner surface of the rear panel 32E when in a folded configuration, and a front extension tab 42E, designed to engage the inner surface of the front panel 30E when in a folded configuration. Similarly, the opposing exterior side panel 36E also includes a rear extension tab 40E, designed to engage the inner surface of the rear panel 32E when in a folded configuration, and a front extension tab 44E, designed to engage the inner surface of the front panel 30E when in a folded configuration. Alternatively, the rear extension tabs 38E, 40E may engage the outer surface of the rear panel 32E, and the front extension tabs 42E, 44E may engage the outer surface of the front panel 30E.

In this embodiment, each secondary blank 24E, 26E includes an outer edge 46E and an inner edge 48E. First and second secondary blank fold lines 50E, 52E are located near the outer edge 46E, and define a support panel 54E therebetween. The secondary blanks 24E, 26E also include an interior side panel 56E, positioned between the second secondary blank fold line 52E and a third secondary blank fold line 58E. The area and size of the interior side panel 56E is approximately equal to that of the exterior side panel 34E, 36E of the primary blank 22E.

As seen in FIG. 21, the first and second secondary blanks 24E, 26E are affixed to the inner surface of the primary blank 22E. The secondary blanks 24E, 26E are affixed to the inner surface of the primary blank 22E such that the footprints of the secondary blanks 24E, 26E are entirely located within the footprint of the primary blank 22E. An upper adhesive area 62E of the primary blank 22E is configured to receive an upper adhesive area 64E of the secondary blank 24E, 26E, while a lower adhesive area 66E of the primary blank 22E is configured to receive a lower adhesive area 68E of the secondary blank 24E, 26E. Adhesive areas 62E, 64E are configured to be attached to one another with adhesive (not shown), while adhesive areas 66E, 68E are similarly configured to be attached to one another with an adhesive (not shown). The adhesive may consist of glue, tape, staples or any other bonding device that is used to attach areas of shipping and packaging containers together. The upper adhesive area 62E of the primary blank 22E is located along an outermost edge 70E of the exterior side panel 34E, 36E. The lower adhesive area 66E of the primary blank 22E is located on the interior surface of the bottom panel 28E, within a bottom fold line 72E, which separates the bottom panel 28E from the side panel 34E, 36E. More specifically, the lower adhesive area 66E of the primary blank 22E is not directly adjacent the bottom fold line 72E, but rather is offset slightly from the fold line 72E by a distance approximately equal to the width of the support panel 54E.

Having been attached while in a flat configuration, as illustrated in FIGS. 21 and 22 and discussed in the preceding paragraph, the primary blank 22E and secondary blanks 24E, 26E may subsequently be placed in an erected or folded configuration to form container 20E, in order to receive contents therein. Folding of the blanks 22E, 24E, 26E forces the areas adjacent the first, second, and third secondary blank fold lines 50E, 52E, 58E, respectively, to be oriented at approximately 90 degree angles. Specifically, the arrows indicated on panels 32E and 56E, as seen in FIG. 22 indicate the relative direction of rotation of the panels, as they are folded into an erected configuration. Furthermore, the top of container 20E may be formed by first folding at upper fold lines 174E, 178E, and subsequently folding at upper fold lines 170E, 182E, such that the top panels 168E, 180E engage the top extension tabs 172E, 176E. Accordingly, the interior side panel 56E and exterior side panel 34E, 36E are oriented parallel relative to one another, separated by an air cell having a width approximately equal to the length of the support panel 54E. The support panels 54E of the opposing secondary blanks 24E, 26E thereby form an area parallel to the surface on which the container 20E is set, and provide a greater surface area on which to receive the weight of any containers 20E which may be placed on top of the container 20E. Additionally, the upper edge of container 20E, formed from the upper most edges of the rear panel 32E, exterior side panels 34E, 36E, and frontal panel 30E extend to a height approximately equal to the panel of the upper support panel 54E, thereby providing additional structural support to container 20E. Additionally, the top of the container 20E, formed of panel 168E, tab 172E, tab 176E and panel 180E may provide additional structural support to the container 20E. The container 20E is retained in a folded configuration by means of multiple adhesive points. These adhesive points may include a front adhesive point, located between the front panel 30E and the front extension tabs 42E, 44E, and a rear adhesive point, located between the rear panel 32E and the rear extension tabs 38E, 40E. Each side of the container 20E may include a front and rear adhesive point respectively, such that a total of four adhesive points retain the container 20E in the folded configuration. Furthermore, the top panels 168E, 180E may be affixed to the top extension tabs 172E, 176E and/or exterior side panels 34E, 36E to further secure and/or close the container 20E. It is also understood, that container 20E may be maintained in the folded or erected configuration in any other manner, such as by tape, staples, etc.

VI. Sixth Embodiment

Figure 24:
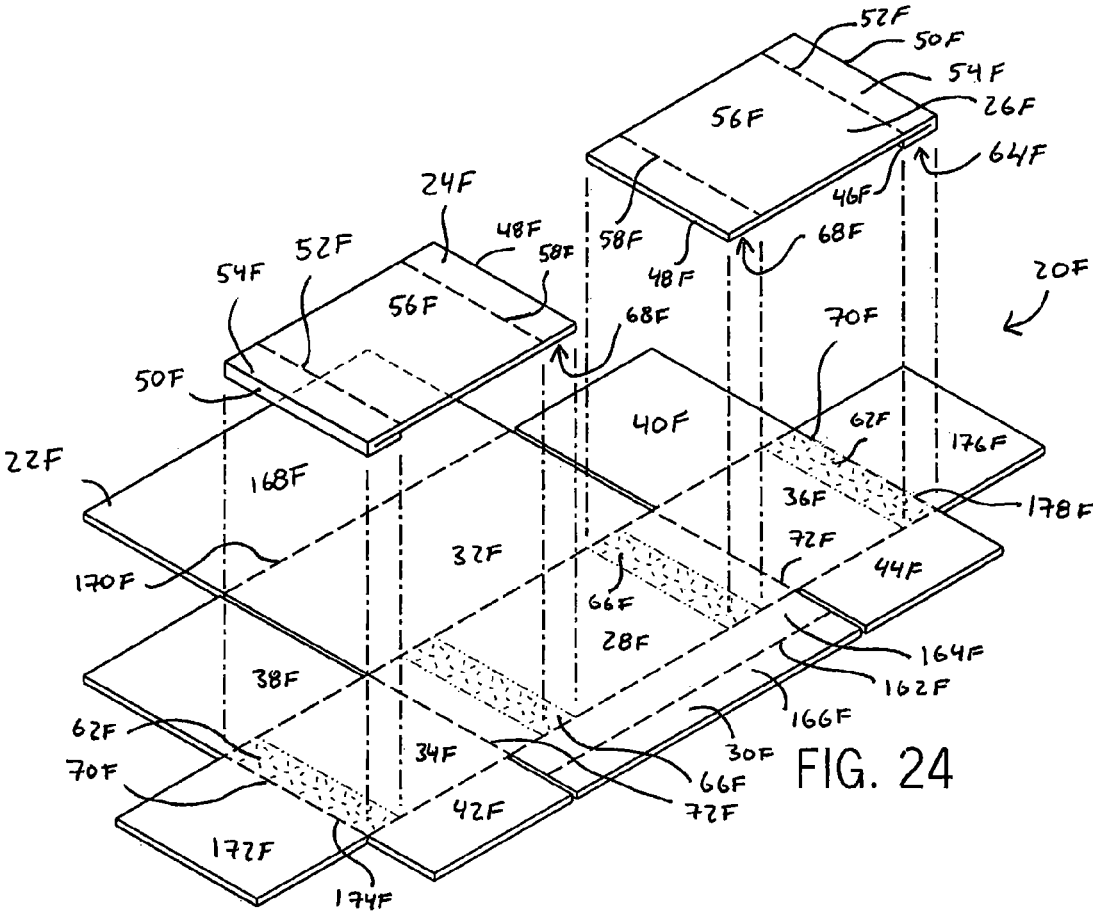
FIG. 24 is an exploded perspective view showing a container in an unfolded configuration, according to another embodiment of the present invention.
Figure 25:
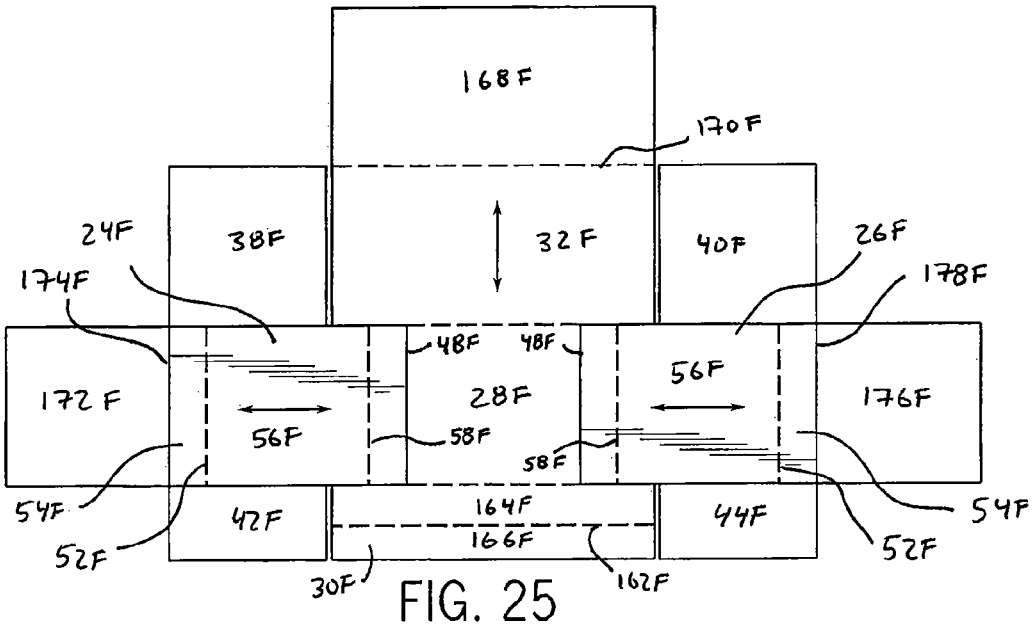
FIG. 25 is a top plan view of the unfolded container of FIG. 24.
Figure 26:
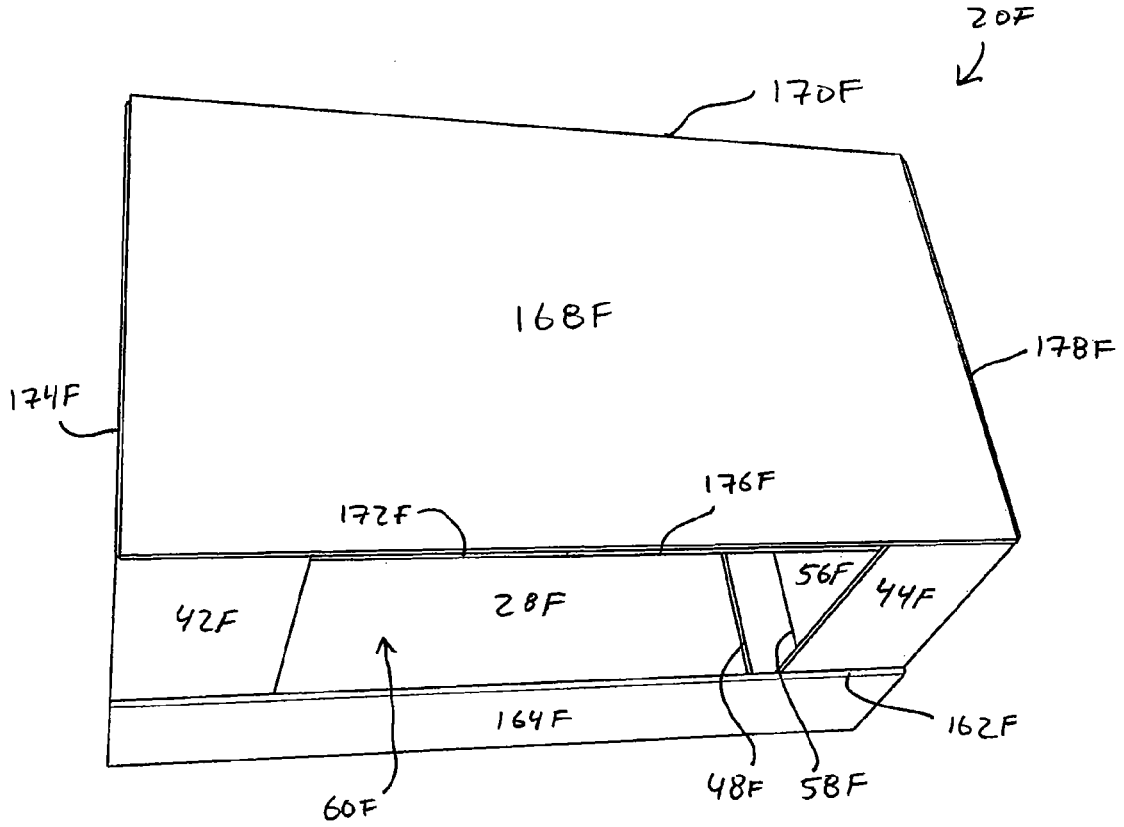
FIG. 26 is a perspective view of the container of FIG. 24, in a folded or erected configuration.

In another alternative embodiment, as illustrated in FIGS. 24-26, container 20F may contain a front panel 30F consisting of a first face 164F and a second face 166F, wherein the first face 164F is separated from the second face 166F along a fold line 162F. Resultantly, in a folded configuration, container 20F may provide a front panel 30F with the second face 166F folded about fold line 162F, to engage the first face 164F. This folded configuration may thereby result in a folded container 20F where the upper edge of the front panel 30F is formed of a smooth fold line 162F, rather than an exposed cut line. Furthermore, container 20F may also contain a rear top panel 168F, such that the rear panel 32F of the primary blank 22F may be contiguous with the rear top panel 168F, separated from the rear panel 32F along rear panel upper fold line 170F. Additionally, side panel 34F may contain a top extension tab 172F, separated from the side panel 24F along the side panel upper fold line 174F, while side panel 36F may contain a top extension tab 176F, separated from the side panel 26F along the side panel upper fold line 178F. Top extension tabs 172F, 176F are configured to engage the underside of the rear top panel 168F when the container 20F is in a folded configuration. As illustrated in FIGS. 24-26, the top extension tabs 172F, 176F may extend approximately half the length of the container 20F, such that their respective outermost edges meet when in a folded configuration. Alternatively, the top extension tabs 172F, 176F may extend less than half the length of the container 20F. This rear top panel 168F, and top extension tabs 172F, 176F may be included in embodiments of the container 20F intended to be used in shipping or stacking, which therefore benefit from the additional structural strength or enclosure provided by top panel 168F. The rear top panel 168F may be removably separated from the rear panel 32F along the rear panel upper fold line 170F formed of perforations. Similarly, the top extension tabs 172F, 176F may be removed from their side panels 34F, 36F along perforated upper fold lines 174F, 178F respectively. In combination, this embodiment removes the rough exposed cut line about the upper edge of the front panel 30F, to provide a more finished appearance, while simultaneously, providing the benefit from the additional structural strength or enclosure provided by top panel 168F.

Furthermore, container 20F of this embodiment may be formed of a primary blank 22F and secondary blanks 24F, 26F. The primary blank 22F includes primarily a bottom panel 28F, a front panel 30F, a rear panel 32F, and two exterior side panels 34F, 36F. The front panel 30F, when folded about fold line 162F may extend to only a portion of the height of the adjacent side panels 34F, 36F, such that the void 60F is located above the front panel 30F, through which products may be seen and easily removed. Exterior side panel 34F also includes a rear extension tab 38F, designed to engage the inner surface of the rear panel 32F when in a folded configuration, and a front extension tab 42F, designed to engage the inner surface of the front panel 30F when in a folded configuration. Similarly, the opposing exterior side panel 36F also includes a rear extension tab 40F, designed to engage the inner surface of the rear panel 32F when in a folded configuration, and a front extension tab 44F, designed to engage the inner surface of the front panel 30F when in a folded configuration. Alternatively, the rear extension tabs 38F, 40F may engage the outer surface of the rear panel 32F, and the front extension tabs 42F, 44F may engage the outer surface of the front panel 30F.

In this embodiment, each secondary blank 24F, 26F includes an outer edge 46F and an inner edge 48F. First and second secondary blank fold lines 50F, 52F are located near the outer edge 46F, and define a support panel 54F therebetween. The secondary blanks 24F, 26F also include an interior side panel 56F, positioned between the second secondary blank fold line 52F and a third secondary blank fold line 58F. The area and size of the interior side panel 56F is approximately equal to that of the exterior side panel 34F, 36F of the primary blank 22F.

As seen in FIG. 24 the first and second secondary blanks 24F, 26F are affixed to the inner surface of the primary blank 22F. The secondary blanks 24F, 26F are affixed to the inner surface of the primary blank 22F such that the footprints of the secondary blanks 24F, 26F are entirely located within the footprint of the primary blank 22F. An upper adhesive area 62F of the primary blank 22F is configured to receive an upper adhesive area 64F of the secondary blank 24F, 26F, while a lower adhesive area 66F of the primary blank 22F is configured to receive a lower adhesive area 68F of the secondary blank 24F, 26F. Adhesive areas 62F, 64F are configured to be attached to one another with adhesive (not shown), while adhesive areas 66F, 68F are similarly configured to be attached to one another with an adhesive (not shown). The adhesive may consist of glue, tape, staples or any other bonding device that is used to attach areas of shipping and packaging containers together. The upper adhesive area 62F of the primary blank 22F is located along an outermost edge 70F of the exterior side panel 34F, 36F. The lower adhesive area 66F of the primary blank 22F is located on the interior surface of the bottom panel 28F, within a bottom fold line 72F, which separates the bottom panel 28F from the side panel 34F, 36F. More specifically, the lower adhesive area 66F of the primary blank 22F is not directly adjacent the bottom fold line 72F, but rather is offset slightly from the fold line 72F by a distance approximately equal to the width of the support panel 54F.

Having been attached while in a flat configuration, as illustrated in FIGS. 24 and 25 and discussed in the preceding paragraph, the primary blank 22F and secondary blanks 24F, 26F may subsequently be placed in an erected or folded configuration to form container 20F, in order to receive contents therein. Folding of the blanks 22F, 24F, 26F forces the areas adjacent the first, second, and third secondary blank fold lines 50F, 52F, 58F, respectively, to be oriented at approximately 90 degree angles. Specifically, the arrows indicated on panels 32F and 56F, as seen in FIG. 25 indicate the relative direction of rotation of the panels, as they are folded into an erected configuration. Accordingly the interior side panel 56F and exterior side panel 34F, 36F are oriented parallel relative to one another, separated by an air cell having a width approximately equal to the length of the support panel 54F. The support panels 54F of the opposing secondary blanks 24F, 26F thereby form an area parallel to the surface on which the container 20F is set, and provide a greater surface area on which to receive the weight of any containers 20F which may be placed on top of the container 20F. Additionally, the upper edge of container 20F, formed from the uppermost edges of the rear panel 32F, and exterior side panels 34F, 36F, and front extension tabs 42F, 44F extend to a height approximately equal to the height of the upper support panel 54F, thereby providing additional structural support to container 20F, as does the rear top panel 168F and top extension tabs 172F, 176F.

The container 20F is retained in a folded configuration by means of multiple adhesive points. These adhesive points may include a front adhesive point, located between the front panel 30F and the front extension tabs 42F, 44F, and a rear adhesive point, located between the rear panel 32F and the rear extension tabs 38F, 40F. Each side of the container 20F may include a front and rear adhesive point respectively, such that a total of four adhesive points retain the container 20F in the folded configuration. Furthermore, when folded, the second face 166F of the front panel 30F may engage the front extension tabs 42F, 44F. Alternatively, the front panel 30F may be located within the container 20F such that the first face 164F engages the interior of the front extension tabs 42F, 44F at the adhesive point 80F. To provide additional support, the first face 164F may be affixed to the second face 166F to maintain their folded configuration. In addition to the use of adhesive or glue, it is understood, that container 20F may be maintained in the folded or erected configuration in any other manner, such as by tape, staples, etc.

VII. Seventh Embodiment

Figure 7:
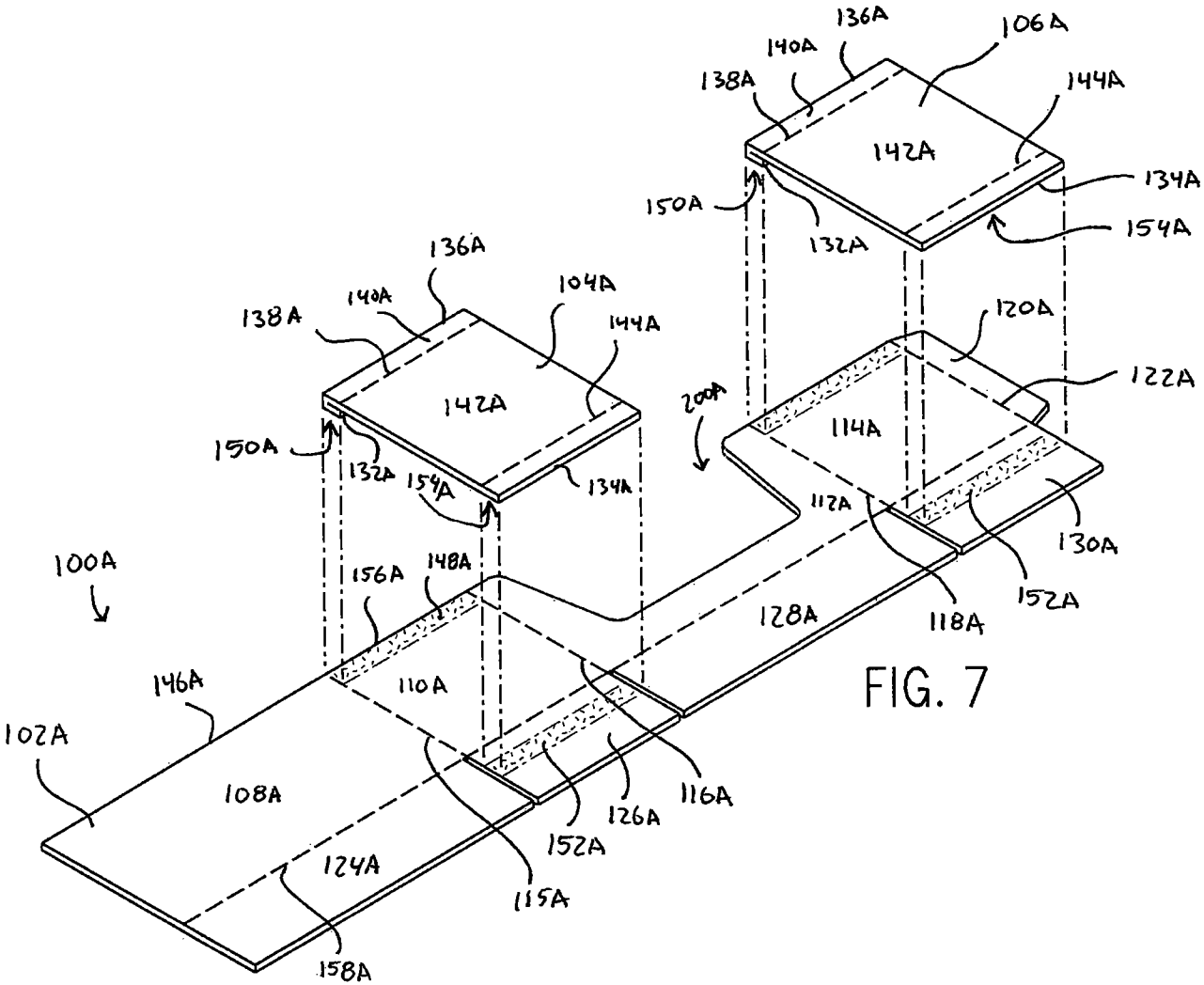
FIG. 7 is an exploded perspective view showing a container in an unfolded configuration, according to an alternative embodiment of the present invention.
Figure 8:
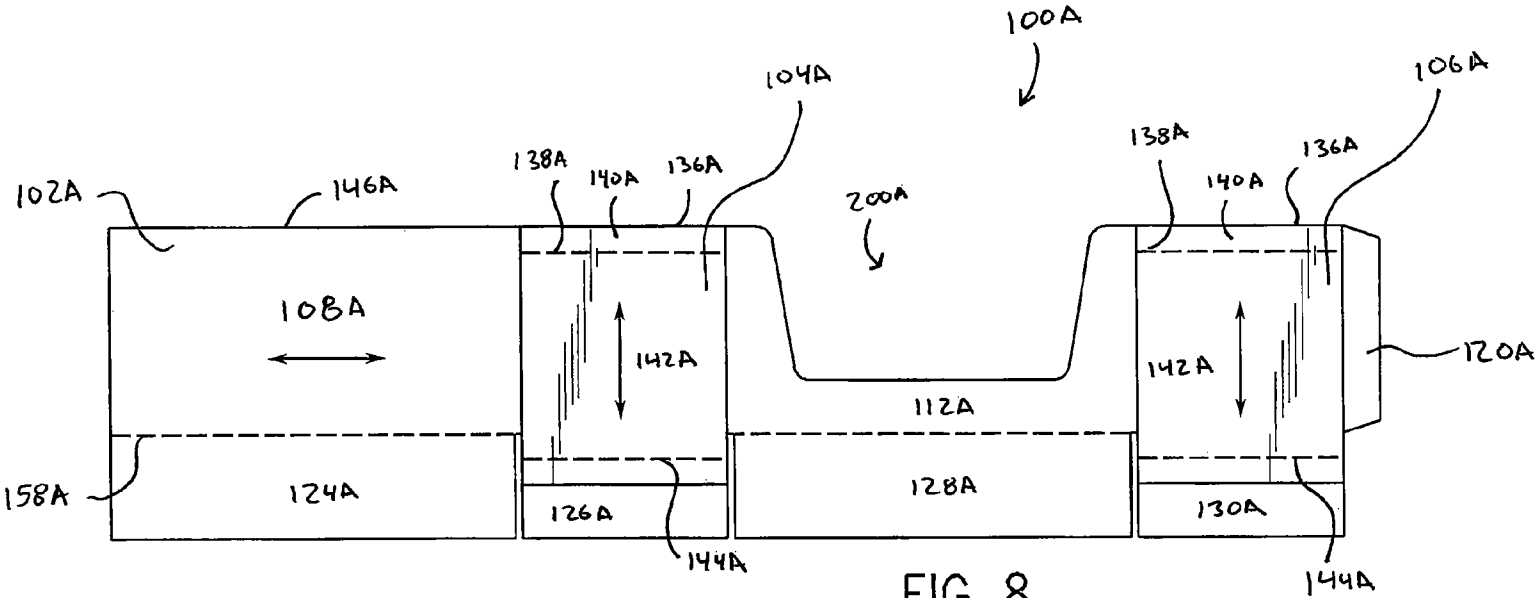
FIG. 8 is a top plan view of the unfolded container of FIG. 7.
Figure 9:
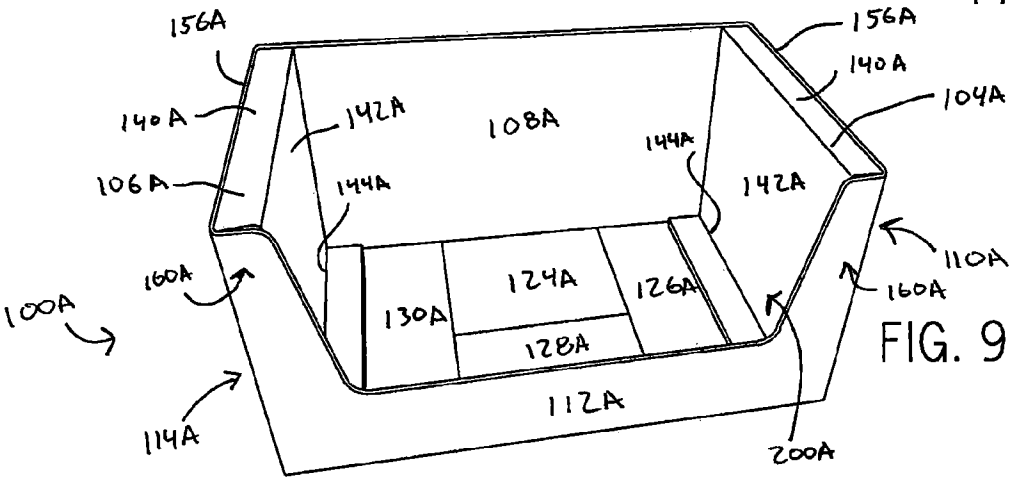
FIG. 9 is a perspective view of the container of FIG. 7, in a folded or erected configuration.

Referring now to FIGS. 7-9, there is shown a container 100A according to another embodiment of the present invention. The container 100A of FIGS. 7-9 is formed of a primary blank 102A and two secondary blanks 104A, 106A of packaging material. The packaging material may consist of corrugated board, fiberboard, or any similar material suitable for use in shipping and display container construction. The corrugated board consists of a fluted corrugated core located between two sheets of kraft paper or linerboard, in a manner as is known. The primary blank 102A and secondary blanks 104A, 106A may be stamped or cut from the packaging material, while in a substantially flat orientation, and subsequently folded to form the container 100A.

FIG. 7 illustrates the primary blank 102A, formed of a single piece of packaging material in a flat orientation. The primary blank 102A includes primarily a rear panel 108A, a first exterior side panel 110A, a front panel 112A, and a second exterior side panel 114A. The rear panel 108A and first exterior side panel 110A are separated by a first primary blank fold line 115A, the first exterior side panel 110A and front panel 112A are separated by a second primary blank fold line 116A, and the front panel 112A and second exterior side panel 114A are separated by a third primary blank fold line 118A. The second exterior side panel 114A also includes a side extension tab 120A, designed to engage the inner or outer surface of the rear panel 108 when in a folded configuration. The second exterior side panel 114A is separated from the side extension tab 120A by a fourth primary blank fold line 122A. Alternatively, the side extension tab 120A may be located contiguously with rear panel 108A, where the fourth primary blank fold line 122A is located between the side extension tab 120A and the rear panel 108A. In this embodiment, the side extension tab is configured to engage the inner or outer surface of the side panel 114A in a folded configuration. As seen in FIGS. 7-9, the front panel 112A may have a height less than that of the exterior side panels 110A, 114A and rear panel 108A, such that the void 200A is located either within or above the front panel 112A, so as to facilitate easy access to and removal of the products contained within the container 100A. Furthermore each panel, namely the rear panel 108A, first exterior side panel 110A, front panel 112A, and second exterior side panel 114A, have bottom panel extensions 124A, 126A, 128A, 130A respectively, connected thereto. The bottom panel extensions 124A, 126A, 128A, 130A are separated from the rear panel 108A, first exterior side panel 110A, front panel 112A, and second exterior side panel 114A, respectively, by a bottom primary blank fold line 158A. The four bottom panel extensions 124A, 126A, 128A, 130A are designed to engage one another when the container 100A is in a folded configuration to form a united bottom panel of the container 100A.

FIG. 7 illustrates the secondary blanks 104A, 106A, each of which are formed of a single piece of packaging material in a substantially flat configuration. The secondary blanks 104A, 106A each include an upper edge 132A and a lower edge 134A. A first and a second secondary blank fold line 136A, 138A, respectively, are located near the upper edge 132A, and define a support panel 140A there between. Each secondary blank 104A, 106A also includes an interior side panel 142A, positioned between the second and third secondary blank fold lines 138A, 144A. The area and size of the interior side panel 142A is approximately equal to that of each of the exterior side panels 110A, 114A of the primary blank 102A.

The first and second secondary blanks 104A, 106A are affixed to the inner surface of the primary blank 102A. The secondary blanks 104A, 106A are affixed to the inner surface of the primary blank 102A such that the footprints of the secondary blanks 104A, 106A are entirely located within the footprint of the primary blank 102A. An upper adhesive area 148A of the primary blank 102A is configured to receive an upper adhesive area 150A of the secondary blank 104A, 106A, while a lower adhesive area 152A of the primary blank 102A is configured to receive a lower adhesive area 154A of the secondary blank 104A, 106A. Adhesive areas 148A, 150A are configured to be attached to one another with adhesive, as are adhesive areas 134A, 152A. The adhesive may consist of glue, tape, staples or any other bonding device that is used to attach areas of shipping and packaging containers together. The upper adhesive area 148A of the primary blank 102A is located along an upper edge 156A of the exterior side panels 110A, 114A. The lower adhesive area 152A of the primary blank 102A is located on the interior surface of the bottom panel extension 126A, 130A, below the corresponding exterior side panel 110A, 114A, as illustrated in FIG. 7. The lower adhesive area 152A of the primary blank 102A is located on the opposing side of the primary blank bottom fold line 158A, as compared to the upper adhesive area 148A of the primary blank 102A. More specifically, the lower adhesive area 152A of the primary blank 102A is not directly adjacent the primary blank bottom fold line 158A, but rather is offset slightly from the primary blank bottom fold line 158A by a distance approximately equal to the width of the support panel 140A.

With respect to the secondary blanks 104A, 106A, as seen in FIG. 7, the upper adhesive area 150A of each secondary blank 104A, 106A is located between the upper edge 132A of the secondary blank 104A, 106A and the support panel 140A, where the support panel 140A is defined as the area between the first secondary blank fold line 136A and the second secondary blank fold line 138A. The lower adhesive area 154A of each secondary blank 104A, 106A is located on the opposite side of the secondary blank 104A, 106A as the upper adhesive area 150A, and is positioned between the lower edge 134A of the secondary blank 104A, 106A and the third secondary blank fold line 144A.

As illustrated in FIGS. 7-9, the primary blank 102A and secondary blanks 104A, 106A will now be described in an attached configuration. The upper adhesive area 148A of the primary blank 102A is configured to receive the upper adhesive area 150A of each secondary blank 104A, 106A, while the lower adhesive area 152A of the primary blank 102A is configured to receive the lower adhesive area 154A of the secondary blanks 104A, 106A. Due to the adhesive areas 150A, 154A of the secondary blank 104A, 106A being located on opposite surfaces of the secondary blank 104A, 106A, the secondary blank 104A, 106A is folded approximately 180 degrees about the first secondary blank fold line 136A, when the container 100A is in an unfolded, i.e. substantially flat configuration. The blanks 102A, 104A, 106A are configured such that the fold lines 136A, 138A, 144A of the secondary blank 102A, 104A do not overlap the primary blank bottom fold line 158A. Rather the blanks 102A, 104A, 106A are configured such that the third secondary blank fold line 144A of each secondary blank 104A, 106A is offset from the primary blank 102A bottom fold line 158A, by a distance approximately equal to the width of the support panel 140A, i.e. the distance between the first and second fold lines 136A, 138A of the secondary blank 104A, 106A. The locations of the relative adhesive areas 148A, 150A, 152A, 154A are further illustrated in FIG. 7.

Having been attached while in a flat configuration, as illustrated in FIG. 8, the primary blank 102A and secondary blanks 104A, 106A may subsequently be placed in a folded configuration to form container 100A, in order to receive contents therein. The folded configuration of container 100A is illustrated in FIG. 9. Moreover, the arrows indicated on panels 108A and 142A, as seen in FIG. 8, indicate the relative direction of rotation of the panels, as they are folded into an erected configuration. Folding of the blanks 102A, 104A, 106A forces the areas adjacent the first, second, and third fold lines 136A, 138A, 144A, respectively, of the secondary blanks 104A, 106A to be oriented at approximately 90 degree angles. Accordingly, as seen in FIG. 9, the exterior side panels 110A, 114A and interior panels 142A are oriented parallel relative to one another, and are separated by an air cell, i.e. hollow space 160A, having a width equal to the length of the support panel 140A. The support panels 140A of the two opposing secondary blanks 104A, 106A thereby form an area parallel to the bottom of the container 100A, i.e. the surface on which the container is set, and provides a greater surface area on which to receive the weight of any containers 100A which may be placed on top of the lower container 100A.

VIII. Eighth Embodiment

Figure 13:
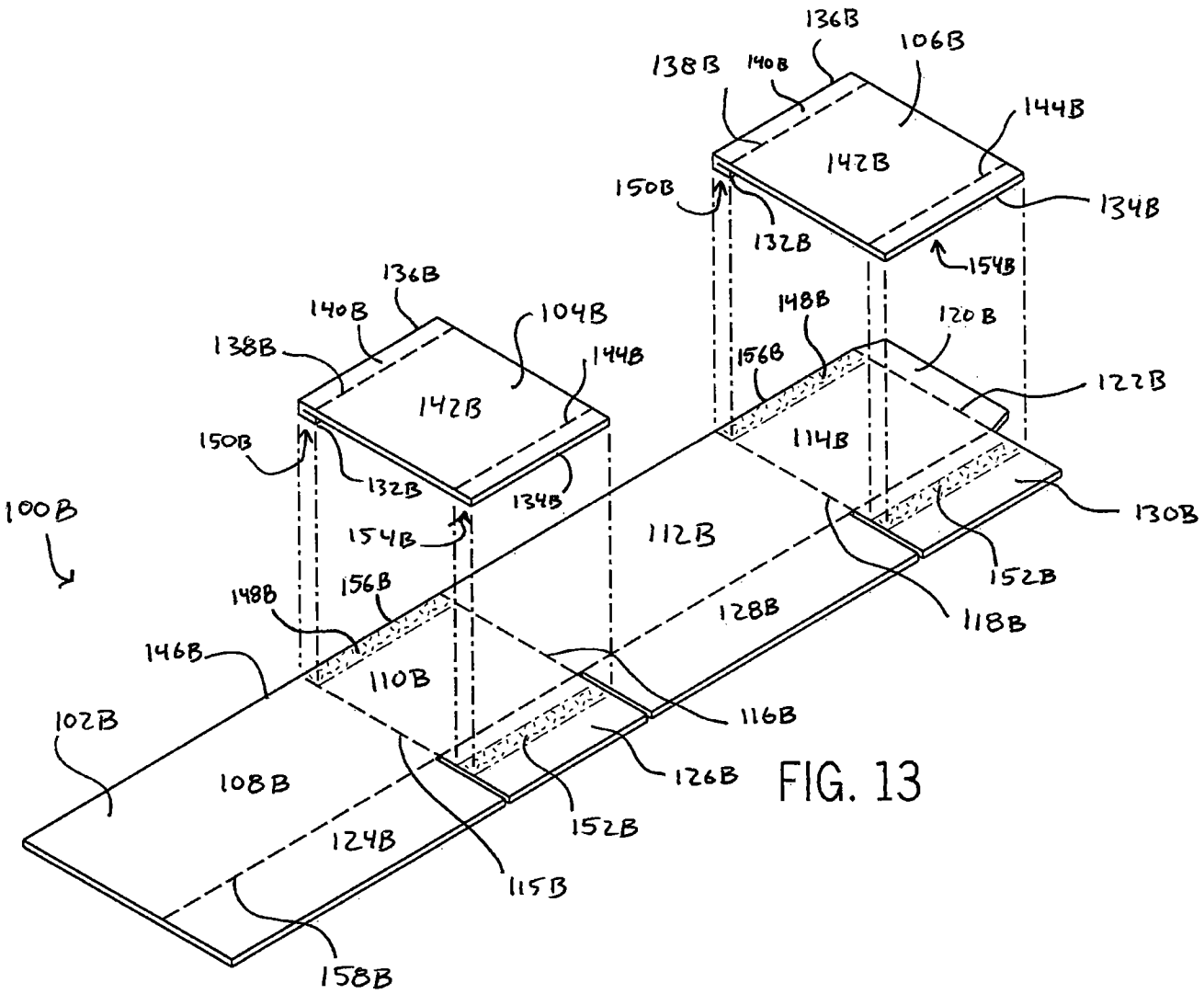
FIG. 13 is an exploded perspective view showing a container in an unfolded configuration, according to anther embodiment of the present invention.
Figure 14:
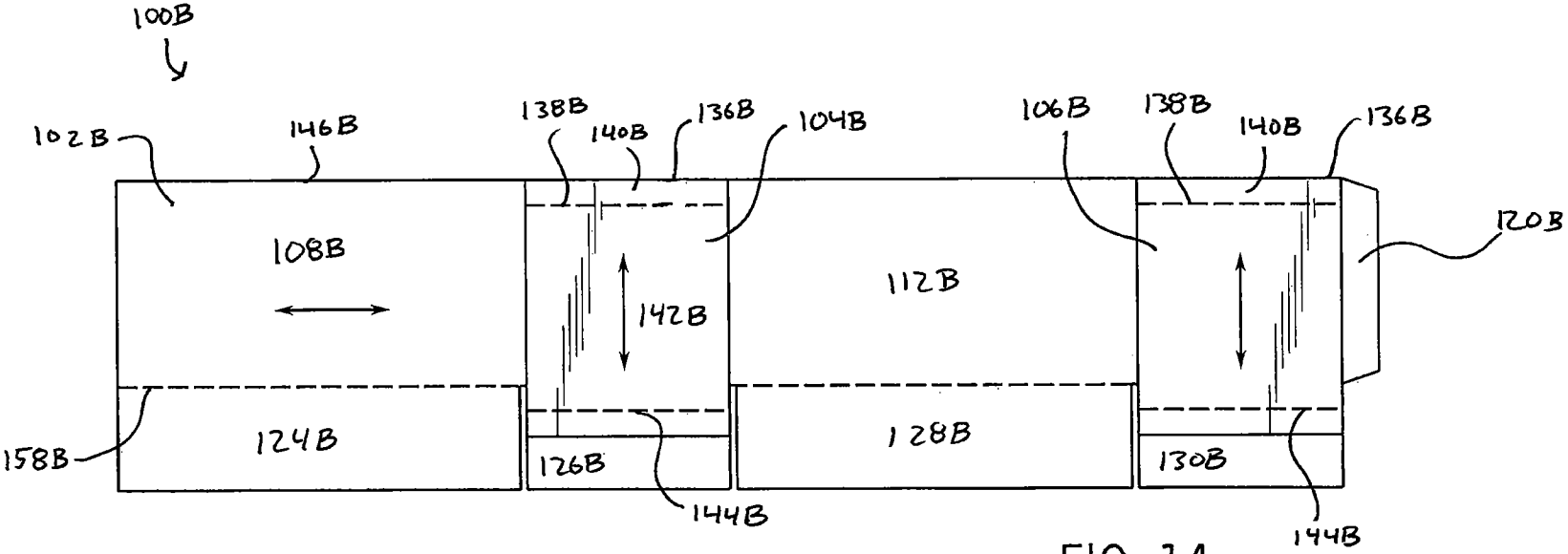
FIG. 14 is a top plan view of the unfolded container of FIG. 13.
Figure 15:
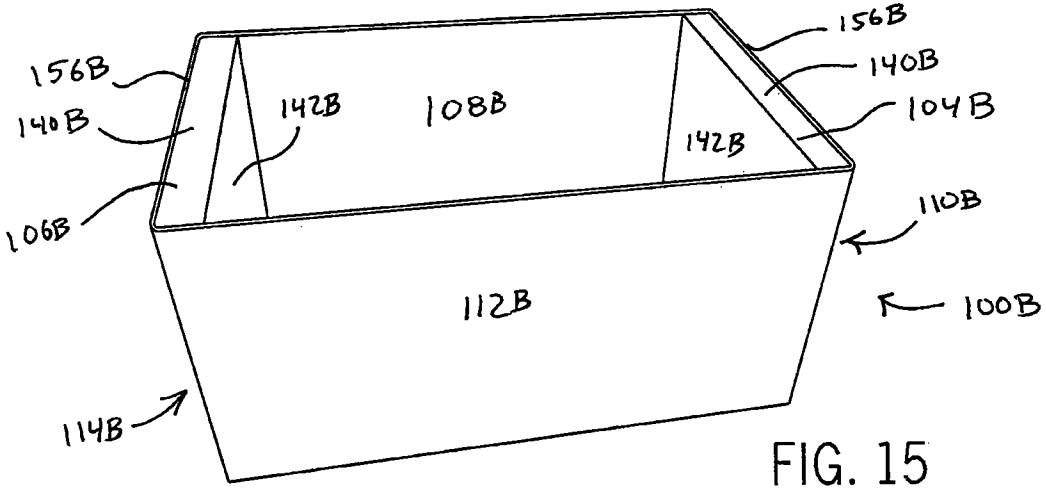
FIG. 15 is a perspective view of the container of FIG. 13, in a folded or erected configuration.

In an alternative embodiment, as illustrated in FIGS. 13-15, container 100B may contain a front panel 112B having a height consistent with that of rear panel 108B and exterior side panels 110B, 114B. Resultantly, in a folded configuration, container 100B may provide an upper edge of consistent height about all four sides of the container 100B. Specifically, the container 100B according to this embodiment may include a primary blank 102B and two secondary blanks 104B, 106B. The primary blank 102B includes primarily a rear panel 108B, a first exterior side panel 110B, a front panel 112B, and a second exterior side panel 114B. The rear panel 108B and first exterior side panel 110B are separated by a first primary blank fold line 115B, the first exterior side panel 110B and front panel 112B are separated by a second primary blank fold line 116B, and the front panel 112B and second exterior side panel 114B are separated by a third primary blank fold line 118B. The second exterior side panel 114B also includes a side extension tab 120B, designed to engage the inner or outer surface of the rear panel 108B when in a folded configuration. The second exterior side panel 114B is separated from the side extension tab 120B by a fourth primary blank fold line 122B. Alternatively, the side extension tab 120B may be located adjacent rear panel 108B, where the fourth primary blank fold line 122B is located between the side extension tab 120B and the rear panel 108B. In this embodiment the side extension tab is configured to engage the inner or outer surface of the side panel 114B in a folded configuration. Furthermore each panel, namely the rear panel 108B, first exterior side panel 110B, front panel 112B, second exterior side panel 114B, have bottom panel extensions 124B, 126B, 128B, 130B respectively, connected thereto. The bottom panel extensions 124B, 126B, 128B, 130B are separated from the rear panel 108B, first exterior side panel 110B, front panel 112B, and second exterior side panel 114B, respectively, by a bottom primary blank fold line 158B. The four bottom panel extensions 124B, 126B, 128B, 130B are designed to engage one another when the container 100B is in a folded configuration to form a united bottom panel of the container 100B.

In this embodiment, the first and second secondary blanks 104B, 106B are affixed to the inner surface of the primary blank 102B. The secondary blanks 104B, 106B are affixed to the inner surface of the primary blank 102B such that the footprints of the secondary blanks 104B, 106B are entirely located within the footprint of the primary blank 102B. An upper adhesive area 148B of the primary blank 102B is configured to receive an upper adhesive area 150B of the secondary blank 104B, 106B, while a lower adhesive area 152B of the primary blank 102B is configured to receive a lower adhesive area 154B of the secondary blank 104B, 106B. The upper adhesive area 148B of the primary blank 102B is located along an upper edge 156B of the exterior side panels 110B, 114B. The lower adhesive area 152B of the primary blank 102B is located on the interior surface of the bottom panel extension 126B, 130B, below the corresponding exterior side panel 110B, 114B, as illustrated in FIG. 13. The lower adhesive area 152B of the primary blank 102B is located on the opposing side of the primary blank bottom fold line 158B, as compared to the upper adhesive area 148B of the primary blank 102B. More specifically, the lower adhesive area 152B of the primary blank 102B is not directly adjacent the primary blank bottom fold line 158B, but rather is offset slightly from the primary blank bottom fold line 158B by a distance approximately equal to the width of the support panel 140B As illustrated in FIGS. 13-15, the primary blank 102B and secondary blanks 104B, 106B will now be described in an attached configuration. The upper adhesive area 148B of the primary blank 102B is configured to receive the upper adhesive area 150B of each secondary blank 104B, 106B, while the lower adhesive area 152B of the primary blank 102B is configured to receive the lower adhesive area 154B of the secondary blanks 104B, 106B. Due to the adhesive areas 150B, 154B of the secondary blank 104B, 106B being located on opposite surfaces of the secondary blank 104B, 106B, the secondary blank 104B, 106B is folded approximately 180 degrees about the first secondary blank fold line 136B, when the container 100B is in an unfolded, i.e. substantially flat configuration. The blanks 102B, 104B, 106B are configured such that the fold lines 136B, 138B, 144B of the secondary blank 104B, 106B do not overlap the primary blank bottom fold line 158B. Rather, the blanks 102B, 104B, 106B are configured such that the third secondary blank fold line 144B of each secondary blank 104B, 106B is offset from the primary blank 102B bottom fold line 158B, by a distance approximately equal to the width of the support panel 140B, i.e. the distance between the first and second fold lines 136B, 138B of the secondary blank 104B, 106B. The locations of the relative adhesive areas 148B, 150B, 152B, 154B are further illustrated in FIG. 13.

Having been attached while in a flat configuration, as illustrated in FIG. 14, the primary blank 102B and secondary blanks 104B, 106B may subsequently be placed in a folded configuration to form container 100B, in order to receive contents therein. The folded configuration of container 100B is illustrated in FIG. 15. Moreover, the arrows indicated on panels 108B and 142B, as seen in FIG. 14, indicate the relative direction of rotation of the panels, as they are folded into an erected configuration. Folding of the blanks 102B, 104B, 106B forces the areas adjacent the first, second, and third fold lines 136B, 138B, 144B, respectively, of the secondary blanks 104B, 106B to be oriented at approximately 90 degree angles. Accordingly, as seen in FIG. 15, the exterior side panels 110B, 114B and interior panels 142B are oriented parallel relative to one another, and are separated by an air cell, i.e. hollow space, having a width equal to the length of the support panel 140B. The support panels 140B of the two opposing secondary blanks 104B, 106B thereby form an area parallel to the bottom of the container 100B, i.e. the surface on which the container is set, and provides a greater surface area on which to receive the weight of any containers 100B which may be placed on top of the lower container 100B. Furthermore, in this embodiment, the continuous upper edge of container 100B also contributes to the additional stability of the container 100B, and its ability to receive the weight of any additional containers 100B which may be placed on top of it.

IX. Ninth Embodiment

Figure 27:
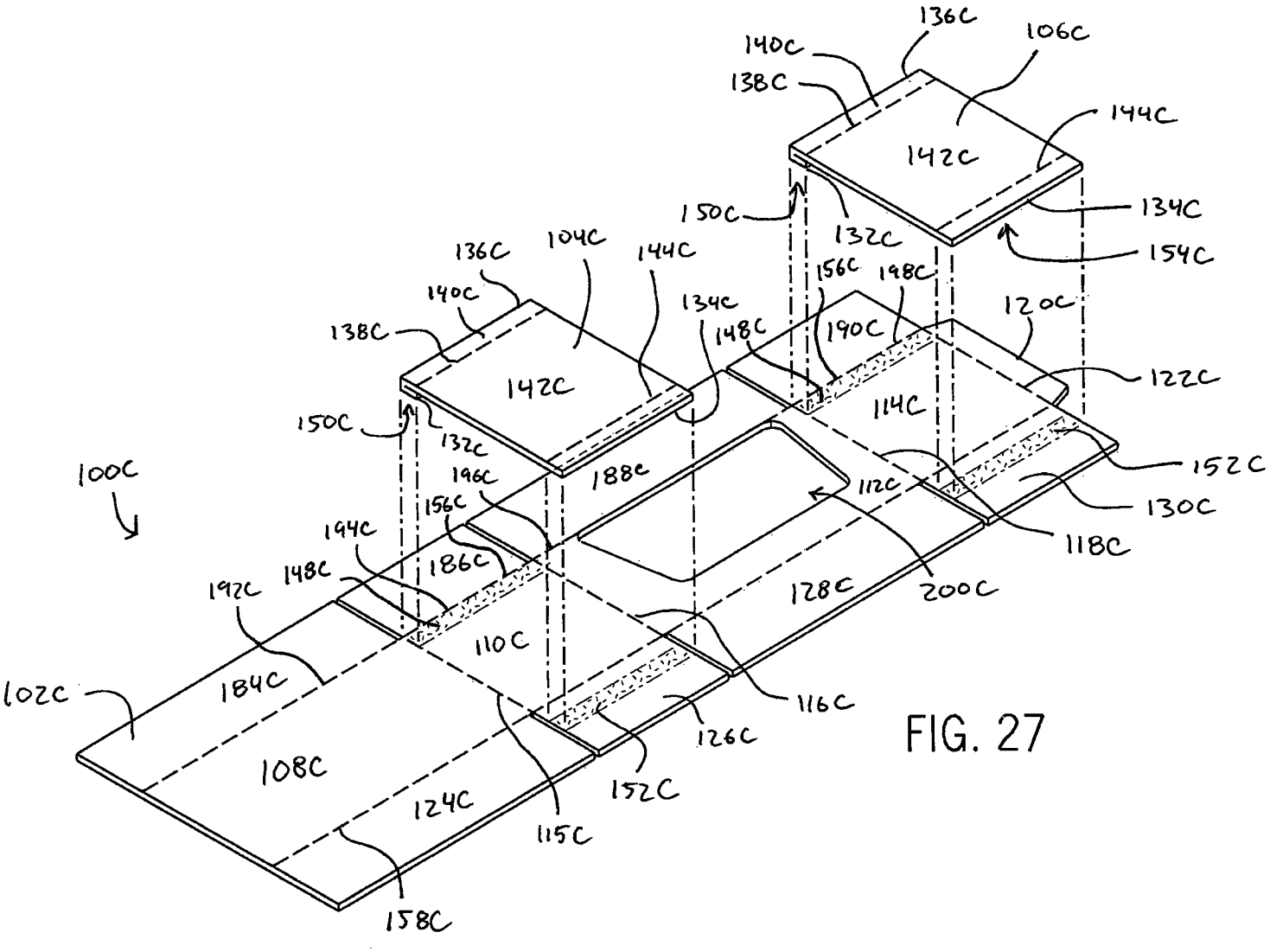
FIG. 27 is an exploded perspective view showing a container in an unfolded configuration, according to another embodiment of the present invention.
Figure 28:
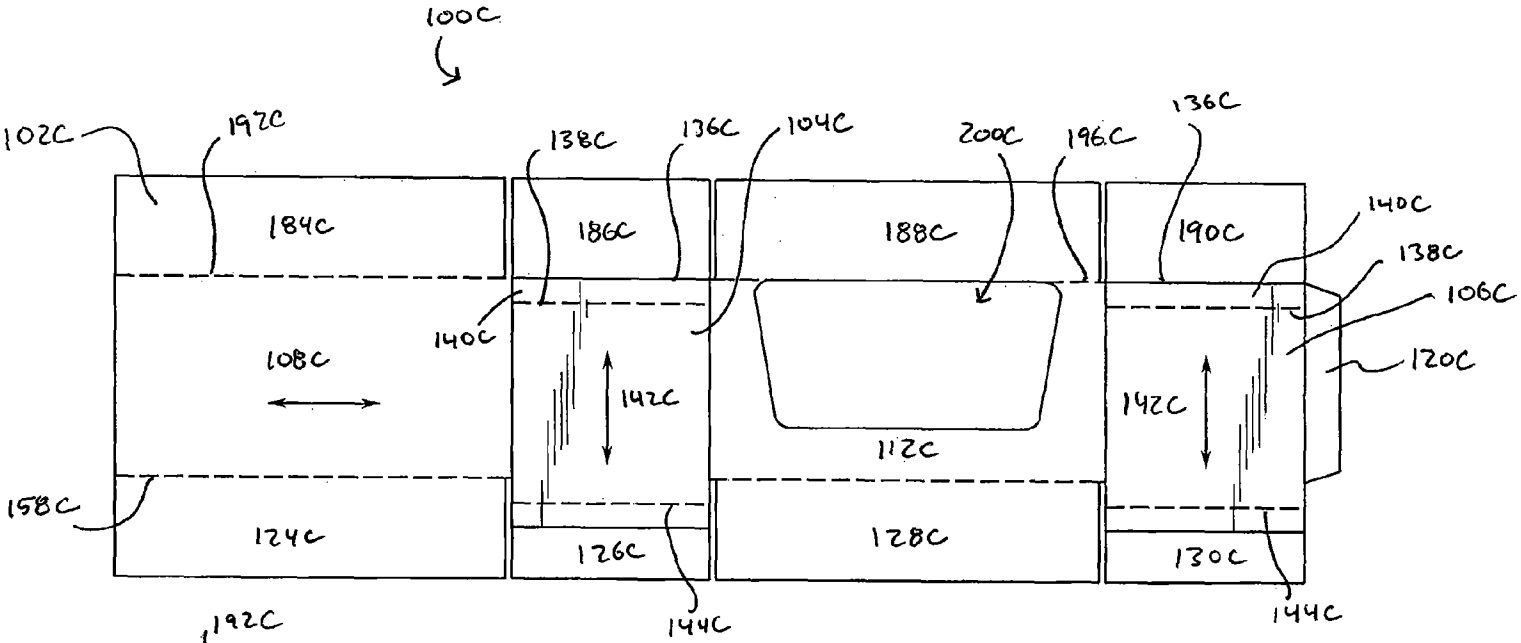
FIG. 28 is a top plan view of the unfolded container of FIG. 27.
Figure 29:
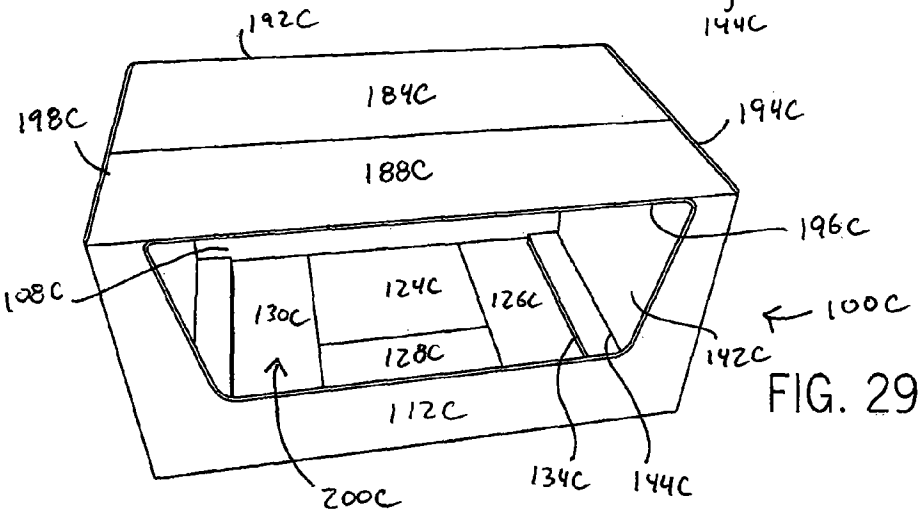
FIG. 29 is a perspective view of the container of FIG. 27, in a folded or erected configuration.

In yet another alternative embodiment, as illustrated in FIGS. 27-29, the primary blank 102C of the container 100C may contain a top formed of a rear top panel 184C, a front top panel 188C, and two side top extensions 186C, 190C. The rear top panel 184C may be contiguous with the rear panel 108C, separated from the rear panel 108C along rear panel upper fold line 192C, while the front top panel 188C may be contiguous with the front panel 112C, separated from the front panel 112C along front panel upper fold line 196C. The two side top extensions 186C, 190C may be contiguous with their respective side panels 110C, 114C respectively, and separated therefrom by respective side panel upper fold lines 194C, 198C. As seen in FIGS. 27-29, the front top panel 188C may be attached to the front panel 112C at two outermost points along the front panel upper fold line 196C, so as to allow the front panel 112C to retain void 200C, located within the front panel 112C, and to facilitate easy access to and removal of the products contained within the container 100C. Alternatively, the void 200C in the front panel 112C may consist of a perforated area within a solid front panel 112C, such that the container 100C may be shipped in an enclosed configuration, and the perforated area may then be removed from the front panel 112C, when access to the packaged contents is desired, i.e. when the package is used as for product display and dispensing. Furthermore, in the folded configuration of FIG. 29, the side top extensions 186C, 190C are configured to engage the underside of the top panels 184C, 186C when the container 100C is in a closed configuration. The side top extensions 186C, 190C may extend approximately half the length of the container 100C, such that their respective outermost edges meet when in a folded configuration. Alternatively, the side top extensions 186C, 190C may extend less than half the length of the container 100C, as illustrated in FIGS. 27-28. More specifically, the container 100C according to this embodiment may include a primary blank 102C and two secondary blanks 104C, 106C. The primary blank 102C includes primarily a rear panel 108C, a first exterior side panel 110C, a front panel 112C, and a second exterior side panel 114C. The rear panel 108C and first exterior side panel 110C are separated by a first primary blank fold line 115C, the first exterior side panel 110C and front panel 112C are separated by a second primary blank fold line 116C, and the front panel 112C and second exterior side panel 114C are separated by a third primary blank fold line 118C. The second exterior side panel 114C also includes a side extension tab 120C, designed to engage the inner or outer surface of the rear panel 108C when in a folded configuration. The second exterior side panel 114C is separated from the side extension tab 120C by a fourth primary blank fold line 122C. Alternatively, the side extension tab 120C may be located adjacent rear panel 108C, where the fourth primary blank fold line 122C is located between the side extension tab 120C and the rear panel 108C. In this embodiment, the side extension tab is configured to engage the inner or outer surface of the side panel 114C in a folded configuration. Furthermore each panel, namely the rear panel 108C, first exterior side panel 110C, front panel 112C, and second exterior side panel 114C, have bottom panel extensions 124C, 126C, 128C, 130C respectively, connected thereto. The bottom panel extensions 124C, 126C, 128C, 130C are separated from the rear panel 108C, first exterior side panel 110C, front panel 112C, and second exterior side panel 114C, respectively, by a bottom primary blank fold line 158C. The four bottom panel extensions 124C, 126C, 128C, 130C are designed to engage one another when the container 100C is in a folded configuration to form a united bottom panel of the container 100C.

In this embodiment, the first and second secondary blanks 104C, 106C are affixed to the inner surface of the primary blank 102C. The secondary blanks 104C, 106C are affixed to the inner surface of the primary blank 102C such that the footprints of the secondary blanks 104C, 106C are entirely located within the footprint of the primary blank 102C. An upper adhesive area 148C of the primary blank 102C is configured to receive an upper adhesive area 150C of the secondary blank 104C, 106C, while a lower adhesive area 152C of the primary blank 102C is configured to receive a lower adhesive area 154C of the secondary blank 104C, 106C. The upper adhesive area 148C of the primary blank 102C is located along an upper edge 156C of the exterior side panels 110C, 114C. The lower adhesive area 152C of the primary blank 102C is located on the interior surface of the bottom panel extension 126C, 130C, below the corresponding exterior side panel 110C, 114C, as illustrated in FIG. 27. The lower adhesive area 152C of the primary blank 102C is located on the opposing side of the primary blank bottom fold line 158C, as compared to the upper adhesive area 148C of the primary blank 102C. More specifically, the lower adhesive area 152C of the primary blank 102C is not directly adjacent the primary blank bottom fold line 158C, but rather is offset slightly from the primary blank bottom fold line 158C by a distance approximately equal to the width of the support panel 140C As illustrated in FIGS. 27-29, the primary blank 102C and secondary blanks 104C, 106C will now be described in an attached configuration. The upper adhesive area 148C of the primary blank 102C is configured to receive the upper adhesive area 150C of each secondary blank 104C, 106C, while the lower adhesive area 152C of the primary blank 102C is configured to receive the lower adhesive area 154C of the secondary blanks 104C, 106C. Due to the adhesive areas 150C, 154C of the secondary blank 104C, 106C being located on opposite surfaces of the secondary blank 104C, 106C, the secondary blank 104C, 106C is folded approximately 180 degrees about the first secondary blank fold line 136C, when the container 100C is in an unfolded, i.e. substantially flat configuration. The blanks 102C, 104C, 106C are configured such that the fold lines 136C, 138C, 144C of the secondary blank 104C, 106C do not overlap the primary blank bottom fold line 158C. Rather the blanks 102C, 104C, 106C are configured such that the third secondary blank fold line 144C of each secondary blank 104C, 106C is offset from the primary blank 102C bottom fold line 158C, by a distance approximately equal to the width of the support panel 140C, i.e. the distance between the first and second fold lines 136C, 138C of the secondary blank 104C, 106C. The locations of the relative adhesive areas 148C, 150C, 152C, 154C are further illustrated in FIG. 27.

Having been attached while in a flat configuration, as illustrated in FIG. 28, the primary blank 102C and secondary blanks 104C, 106C may subsequently be placed in a folded configuration to form container 100C, in order to receive contents therein. The folded configuration of container 100C is illustrated in FIG. 29. Moreover, the arrows indicated on panels 108C and 142C, as seen in FIG. 28, indicate the relative direction of rotation of the panels, as they are folded into an erected configuration. Folding of the blanks 102C, 104C, 106C forces the areas adjacent the first, second, and third fold lines 136C, 138C, 144C, respectively, of the secondary blanks 104C, 106C to be oriented at approximately 90 degree angles. Accordingly, the exterior side panels 110C, 114C and interior panels 142C are oriented parallel relative to one another, and are separated by an air cell, i.e. hollow space, having a width equal to the length of the support panel 140C. The support panels 140C of the two opposing secondary blanks 104C, 106C thereby form an area parallel to the bottom of the container 100C, i.e. the surface on which the container is set, and provides a greater surface area on which to receive the weight of any containers 100C which may be placed on top of the lower container 100C. Furthermore, in this embodiment, a top of the container 100C is formed of the rear top panel 184C, the front top panel 188C, and two side top extensions 186C, 190C folding about their respective fold lines 192C, 196C, 194C, 198C. The top may thereby provide additional structural strength for receiving additional containers 100C during stacking.

X. Tenth Embodiment

Figure 30:
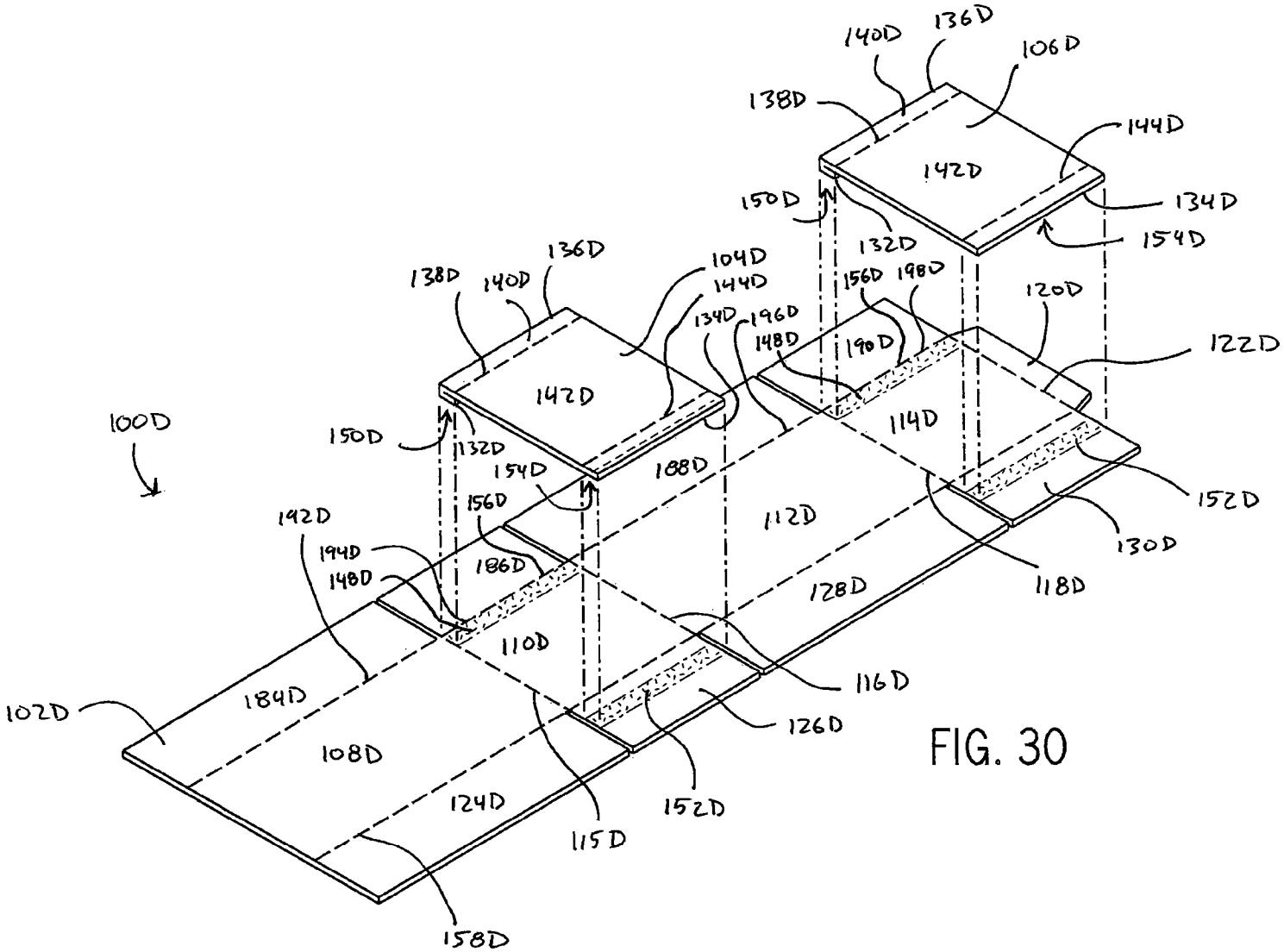
FIG. 30 is an exploded perspective view showing a container in an unfolded configuration, according to yet another embodiment of the present invention.
Figure 31:
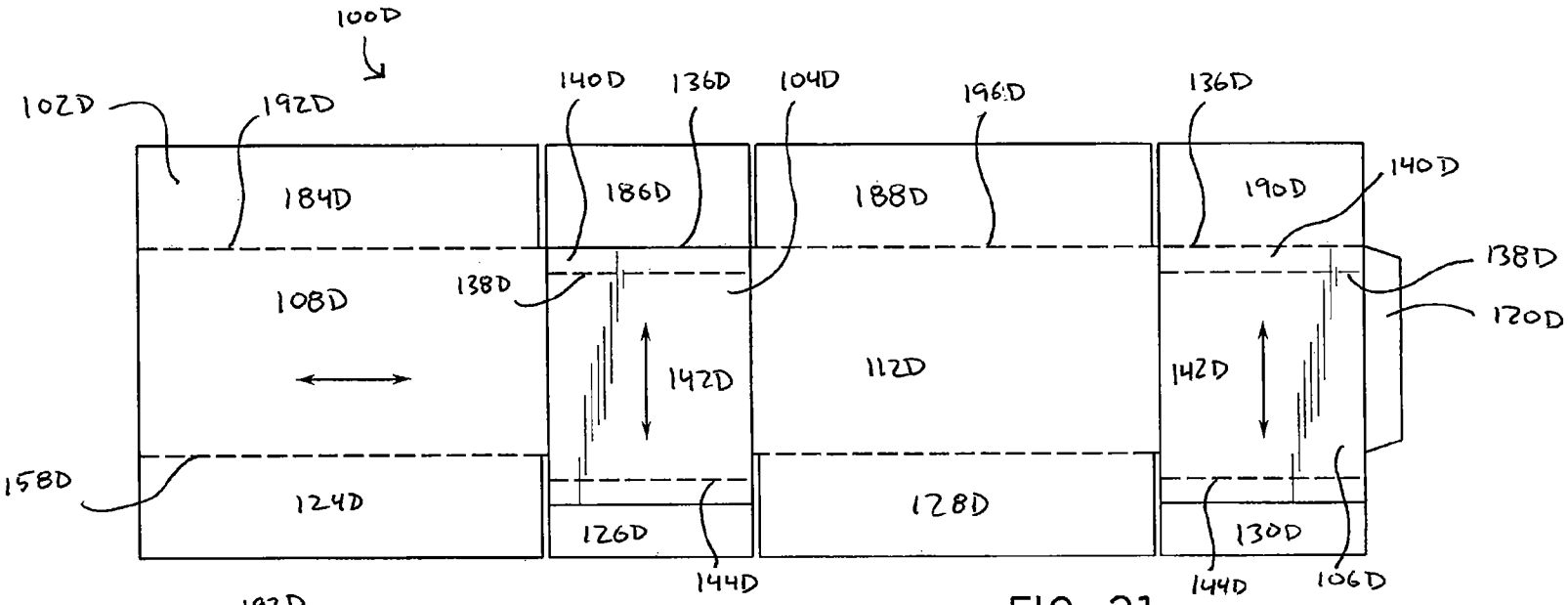
FIG. 31 is a top plan view of the unfolded container of FIG. 30.
Figure 32:
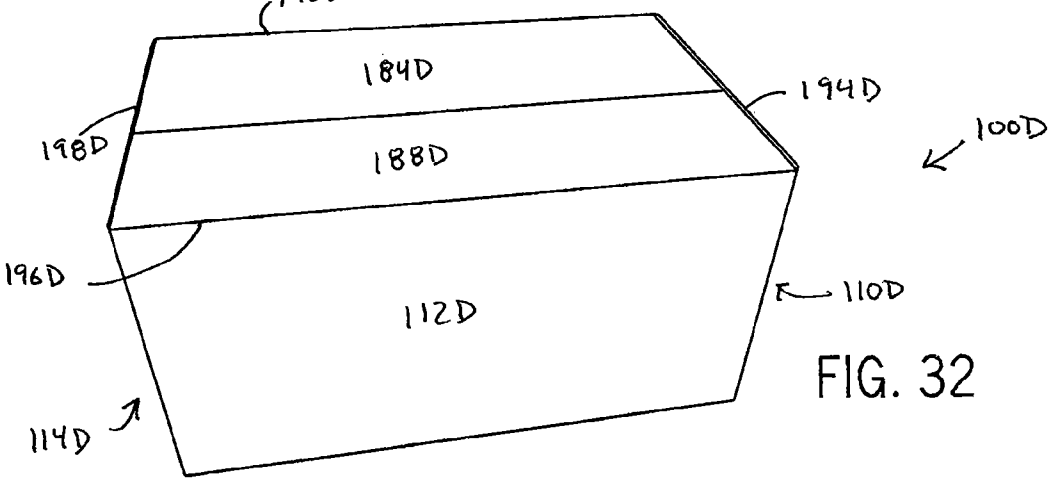
FIG. 32 is a perspective view of the container of FIG. 30, in a folded or erected configuration.

In yet another alternative embodiment, as illustrated in FIGS. 30-32, the primary blank 102D of the container 100D may contain a top formed of a rear top panel 184D, a front top panel 188D, and two side top tabs 186D, 190D. The rear top panel 184D may be contiguous with the rear panel 108D, separated from the rear panel 108D along rear panel upper fold line 192D, while the front top panel 188D may be contiguous with the front panel 112D, separated from the front panel 112D along front panel upper fold line 196D. The two side top tabs 186D, 190D may be contiguous with their respective side panels 110D, 114D respectively, and separated therefrom by respective side panel upper fold lines 194D, 198D. In such an embodiment, the front top panel 188D may be attached to the front panel 112D at the front panel upper fold line 196D, extending the entire length of the front panel 112D, wherein the front panel 112D is a solid surface, lacking an opening therein. As such, in the folded configuration of FIG. 32, the container 100D may form a completely enclosed volume, as may be preferred for shipping packaged goods. Furthermore, in the folded configuration, the side top tabs 186D, 190D are configured to engage the underside of the top panels 184D, 186D when the container 100D is in a closed configuration. The side top tabs 186D, 190D may extend approximately half the length of the container 100D, such that their respective outermost edges meet when in a folded configuration. Alternatively, the side top tabs 186D, 190D may extend less than half the length of the container 100D, as illustrated in FIGS. 30-31.

More specifically, the container 100D according to this embodiment may include a primary blank 102D and two secondary blanks 104D, 106D. The primary blank 102D includes primarily a rear panel 108D, a first exterior side panel 110D, a front panel 112D, and a second exterior side panel 114D. The rear panel 108D and first exterior side panel 110D are separated by a first primary blank fold line 115D, the first exterior side panel 110D and front panel 112D are separated by a second primary blank fold line 116D, and the front panel 112D and second exterior side panel 114D are separated by a third primary blank fold line 118D. The second exterior side panel 114D also includes a side extension tab 120D, designed to engage the inner or outer surface of the rear panel 108D when in a folded configuration. The second exterior side panel 114AD is separated from the side extension tab 120D by a fourth primary blank fold line 122D. Alternatively, the side extension tab 120D may be located adjacent rear panel 108D, where the fourth primary blank fold line 122D is located between the side extension tab 120D and the rear panel 108D. In this embodiment, the side extension tab is configured to engage the inner or outer surface of the side panel 114D in a folded configuration. Furthermore each panel, namely the rear panel 108D, first exterior side panel 110D, front panel 112D and second exterior side panel 114D, have bottom panel extensions 124D, 126D, 128D, 130D respectively, connected thereto. The bottom panel extensions 124D, 126D, 128D, 130D are separated from the rear panel 108D, first exterior side panel 110D, front panel 112D, and second exterior side panel 114D, respectively, by a bottom primary blank fold line 158D. The four bottom panel extensions 124D, 126D, 128D, 130D are designed to engage one another when the container 100D is in a folded configuration to form a united bottom panel of the container 100D.

In this embodiment, the first and second secondary blanks 104D, 106D are affixed to the inner surface of the primary blank 102D. The secondary blanks 104D, 106D are affixed to the inner surface of the primary blank 102D such that the footprints of the secondary blanks 104D, 106D are entirely located within the footprint of the primary blank 102D. An upper adhesive area 148D of the primary blank 102D is configured to receive an upper adhesive area 150D of the secondary blank 104D, 106D, while a lower adhesive area 152D of the primary blank 102D is configured to receive a lower adhesive area 154D of the secondary blank 104D, 106D. The upper adhesive area 148D of the primary blank 102D is located along an upper edge 156D of the exterior side panels 110D, 114D. The lower adhesive area 152D of the primary blank 102D is located on the interior surface of the bottom panel extension 126D, 130D, below the corresponding exterior side panel 110D, 114D, as illustrated in FIG. 30. The lower adhesive area 152D of the primary blank 102D is located on the opposing side of the primary blank bottom fold line 158D, as compared to the upper adhesive area 148D of the primary blank 102D. More specifically, the lower adhesive area 152D of the primary blank 102D is not directly adjacent the primary blank bottom fold line 158D, but rather is offset slightly from the primary blank bottom fold line 158D by a distance approximately equal to the width of the support panel 140D As illustrated in FIGS. 30-32, the primary blank 102D and secondary blanks 104D, 106D will now be described in an attached configuration. The upper adhesive area 148D of the primary blank 102D is configured to receive the upper adhesive area 150D of each secondary blank 104D, 106D, while the lower adhesive area 152D of the primary blank 102D is configured to receive the lower adhesive area 154D of the secondary blanks 104D, 106D. Due to the adhesive areas 150D, 154D of the secondary blank 104D, 106D being located on opposite surfaces of the secondary blank 104D, 106D, the secondary blank 104D, 106D is folded approximately 180 degrees about the first secondary blank fold line 136D, when the container 100D is in an unfolded, i.e. substantially flat configuration. The blanks 102D, 104D, 106D are configured such that the fold lines 136D, 138D, 144D of the secondary blank 104D, 106D do not overlap the primary blank bottom fold line 158D. Rather the blanks 102D, 104D, 106D are configured such that the third secondary blank fold line 144D of each secondary blank 104D, 106D is offset from the primary blank 102D bottom fold line 158D, by a distance approximately equal to the width of the support panel 140D, i.e. the distance between the first and second fold lines 136D, 138D of the secondary blank 104D, 106D. The locations of the relative adhesive areas 148D, 150D, 152D, 154D are further illustrated in FIG. 30.

Having been attached while in a flat configuration, as illustrated in FIG. 31, the primary blank 102D and secondary blanks 104D, 106D may subsequently be placed in a folded configuration to form container 100D, in order to receive contents therein. The folded configuration of container 100D is illustrated in FIG. 32. Moreover, the arrows indicated on panels 108D and 142D, as seen in FIG. 31, indicate the relative direction of rotation of the panels, as they are folded into an erected configuration. Folding of the blanks 102D, 104D, 106D forces the areas adjacent the first, second, and third fold lines 136D, 138D, 144D, respectively, of the secondary blanks 104D, 106D to be oriented at approximately 90 degree angles. Accordingly, the exterior side panels 110D, 114D and interior panels 142D are oriented parallel relative to one another, and are separated by an air cell, i.e. hollow space, having a width equal to the length of the support panel 140D. The support panels 140D of the two opposing secondary blanks 104D, 106D thereby form an area parallel to the bottom of the container 100D, i.e. the surface on which the container is set, and provides a greater surface area on which to receive the weight of any containers 100D which may be placed on top of the lower container 100D. Furthermore, in this embodiment the combination of the top formed of the rear top panel 184D, the front top panel 188D, and two side top extensions 186D, 190D folding about their respective fold lines 192D, 196D, 194D, 198D as well as the full height front panel 112D provides additional support with which to both ship and stack container 100D.

As illustrated in the various embodiments discussed above, the size and shape of the container 20, 100 may vary greatly to accommodate the size and shape of the contents. While the figures have illustrated hand-held size containers, both smaller and larger containers are considered well within the scope of this invention. In this regard, containers for large size items such as home appliances, furniture, or televisions are within the scope of this invention.

It should also be understood that the invention is not limited in its application to the details of construction and arrangements of the components set forth herein. The invention is capable of other embodiments and of being practiced or carried out in various ways. Variations and modifications of the foregoing embodiments are within the scope of the present invention. Specifically, the various features, identified in the numerous embodiments discussed herein may be combined to form additional embodiments, well within the scope of this invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A container, comprising:

a primary blank configured to form an exterior of the container, and at least one secondary blank configured to form an interior side panel of the container, wherein the secondary blank includes a pair of spaced apart end areas that are affixed to the primary blank at spaced apart locations on the primary blank, and wherein the secondary blank further defines an intermediate area located between the end areas, wherein in a first configuration the secondary blank is affixed to the primary blank in a substantially coplanar orientation in which the intermediate area of the secondary blank overlies a facing area of the primary blank; and wherein in a second configuration the primary blank and secondary blank are folded to form an erected container, the erected container having:

a series of exterior panels comprising a bottom panel, a front panel, a rear panel, a first side panel, and a second side panel formed by the primary blank, and an interior side panel formed by the intermediate area of the secondary blank, wherein the interior side panel is formed by the end areas of the secondary blank remaining affixed to the primary blank during movement of the primary and secondary blanks from the first configuration to the second configuration while the intermediate area of the secondary blank is moved to a position that is spaced from the facing area of the primary blank, wherein the facing area of the primary blank defines at least a portion of one of the exterior panels of the erected container, and wherein a void is defined between the interior side panel and the exterior panel, and wherein one of the end areas of the secondary blank defines a support panel disposed along an upper edge of the container that extends between the interior side panel and the exterior panel.

2. The container of claim 1, wherein the at least one secondary blank comprises first and second secondary blanks, each of which is configured to form an interior side panel of the container:

wherein each of the first and second secondary blanks includes a pair of spaced apart end areas that are affixed to the primary blank at spaced apart locations on the primary blank, and further defines an intermediate area located between the end areas;

wherein in a first configuration the first and second secondary blanks are affixed to the primary blank in a substantially coplanar orientation in which the intermediate area of each secondary blank overlies a facing area of the primary blank;

wherein in a second configuration the primary blank and the first and second secondary blanks are folded to form an erected container, the erected container having:

a series of exterior panels comprising a bottom panel, a front panel, a rear panel, a first side panel, and a second side panel formed by the primary blank, and a pair of interior side panels formed by the intermediate areas of the first and second secondary blanks, wherein each interior side panel is formed by the end areas of the secondary blanks remaining affixed to the primary blank during movement of the primary and first and second secondary blanks from the first configuration to the second configuration while the intermediate areas of the secondary blanks are each moved to a position that is spaced from the facing area of the primary blank, wherein each facing area of the primary blank defines at least a portion of one of the exterior panels of the erected container, and wherein a void is defined between each interior side panel and one of the exterior panels, and wherein one of the end areas of each secondary blank defines a support panel disposed along an upper edge of the container that extends between each interior side panel and one of the exterior panels.

3. The container of claim 2, wherein the front panel has a height less than a height of the first and second exterior side panels of the primary blank.

4. The container of claim 2 wherein in the first configuration, footprints of the first and second secondary blank are disposed within a footprint of the primary blank.

5. The container of claim 2, wherein the front panel comprises a fixed lower section, a removable upper section, and a perforated tear line disposed between the fixed lower section and the removable upper section.

6. The container of claim 2, further comprising a top panel, wherein the top panel is pivotably affixed to the rear panel along the upper edge of the rear panel.

7. The container of claim 6, wherein the upper edge further provides a plurality of perforations forming a perforated tear line.

8. A container, comprising:

a primary blank folded to form a bottom, a front panel, a rear panel, a first exterior side panel, and a second exterior side panel; and a secondary blank affixed to the primary blank adjacent the first exterior side panel, the secondary blank forming an interior side panel offset from the first exterior side panel, a support panel disposed between the first interior side panel and the first exterior side panel having a surface that is generally perpendicular to a surface of the first exterior side panel, and a void located below the support panel and between the interior side panel and the first exterior side panel.

9. The container of claim 8, wherein the front panel has a height less than a height of the first and second exterior side panels of the primary blank.

10. The container of claim 8, further comprising a top panel, wherein the top panel is pivotably affixed to the rear panel along an upper edge of the rear panel.

11. The container of claim 10, wherein the upper edge includes a plurality of perforations, and wherein the upper edge is configured to be torn along the plurality of perforations.

12. The container of claim 8, further comprising a second secondary blank affixed to the primary blank adjacent the second exterior side panel, the second secondary blank forming a second interior side panel offset from the second exterior side panel, a second support panel disposed between the second interior side panel and the second exterior side panel, and a void located below the second support panel and between the second interior side panel and the second exterior side panel.

13. The container of claim 12, wherein the first and second support panels are flush with an upper edge of the container.

14. The container of claim 12, wherein the first and second support panels are configured to receive an external weight thereon.

15. The container of claim 14, wherein the interior side panels and exterior side panels are configured to distribute an external weight placed thereon.

16. A method of forming a container, comprising the steps of:

providing a primary blank configured to form a bottom, a front panel, a rear panel, a first exterior side panel, and a second exterior side panel when erected;

affixing a secondary blank to the primary blank adjacent the area of the primary blank that forms the first exterior side panel; and folding the primary and secondary blanks such that the secondary blank forms an interior side panel offset from the first exterior side panel, a support panel disposed between the interior side panel and the first exterior side panel, the support panel having a surface that is generally perpendicular to a surface of the first exterior side panel, and a void located below the support panel and between the side panel and the first exterior side panel.

17. The method of claim 16, further comprising the step of removing a top panel pivotably affixed to the rear panel along a perforated tear line disposed at an upper edge of the rear panel.

18. The method of claim 16, further comprising the step of removing an upper section of the front panel relative to a lower section of the front panel at a perforated tear line disposed between the lower section and the upper section.

19. The method of claim 16, further comprising the steps of affixing a second secondary blank to the primary blank adjacent the area of the primary blank that forms the second exterior side panel, and folding the primary and secondary blanks such that the second secondary blank forms a second interior side panel offset from the second exterior side panel, a second support panel disposed between the second interior side panel and the second exterior side panel, and a void located below the second support panel and between the second interior side panel and the second exterior side panel.

20. The method of claim 19, wherein the step of affixing the secondary blank to the primary blank is carried out such that a footprint of each of the secondary blanks is disposed within a footprint of primary blank.

* * * * *